US011268348B2

(12) United States Patent
Nordheimer

(10) Patent No.: US 11,268,348 B2
(45) **Date of Patent: *Mar. 8, 2022**

(54) SYSTEM FOR SUCCESSIVELY UNCOVERING PORTS ALONG A WELLBORE TO PERMIT INJECTION OF A FLUID ALONG SAID WELLBORE

(71) Applicant: SC ASSET CORPORATION, Calgary (CA)

(72) Inventor: David Nordheimer, Calgary (CA)

(73) Assignee: SC ASSET CORPORATION, Calgary (CA)

( * ) Notice: Subject to any disclaimer, the term of this patent is extended or adjusted under 35 U.S.C. 154(b) by 92 days.

This patent is subject to a terminal disclaimer.

(21) Appl. No.: 16/790,679

(22) Filed: Feb. 13, 2020

(65) Prior Publication Data

US 2020/0182018 A1 Jun. 11, 2020

Related U.S. Application Data

(63) Continuation of application No. 15/805,721, filed on Nov. 7, 2017, now Pat. No. 10,577,890, which is a (Continued)

(30) Foreign Application Priority Data

Sep. 18, 2015 (CA) ..... CA 2904470

(51) Int. Cl.
*E21B 34/14* (2006.01)
*E21B 33/14* (2006.01)
(Continued)

(52) U.S. Cl.
CPC ..... *E21B 34/14* (2013.01); *E21B 33/146* (2013.01); *E21B 34/063* (2013.01); *E21B 43/26* (2013.01); *E21B 2200/06* (2020.05)

(58) Field of Classification Search
CPC ... E21B 34/14; E21B 2034/007; E21B 34/103
See application file for complete search history.

(56) References Cited

U.S. PATENT DOCUMENTS 7,325,617 B2 * 2/2008 Murray ..... E21B 23/02 166/376
7,395,856 B2 * 7/2008 Murray ..... E21B 23/02 166/192

(Continued)

*Primary Examiner* — Steven A MacDonald
(74) *Attorney, Agent, or Firm* — D. Doak Horne

(57) ABSTRACT

A system for successively uncovering a plurality of contiguous ports in a tubing liner within a wellbore, or for successively uncovering individual groups of ports arranged at different but adjacent locations along the liner, to allow successive fracking of the wellbore at such locations. Sliding sleeves in the tubing liner are provided, having a circumferential groove therein, which are successively moved from a closed position covering a respective port to an open position uncovering such port by an actuation member placed in the bore of the tubing liner. Each actuation member comprises a dissolvable plug which in one embodiment is retained by shear pins at an uphole end of a collet sleeve, the latter having radially-outwardly biased protuberances (fingers) which matingly engage sliding sleeves having cylindrical grooves therein, based on the width of the protuberance. In one embodiment, when actuating the most downhole sleeve, the shear pin shears allowing the plug to move in the collet sleeve and prevent the protuberance (fingers) from disengaging.

21 Claims, 13 Drawing Sheets

Related U.S. Application Data continuation of application No. 15/137,961, filed on Apr. 25, 2016, now Pat. No. 9,840,892, which is a continuation-in-part of application No. 14/697,271, filed on Apr. 27, 2015, now Pat. No. 9,840,890, which is a continuation-in-part of application No. 14/505,384, filed on Oct. 2, 2014, now Pat. No. 9,587,464.

(51) Int. Cl.
*E21B 34/06* (2006.01)
*E21B 43/26* (2006.01)

(56) References Cited

U.S. PATENT DOCUMENTS

| | | | | |
|---|---|---|---|---|
| 7,552,779 | B2 * | 6/2009 | Murray | E21B 23/02 166/386 |
| 2007/0221373 | A1 * | 9/2007 | Murray | E21B 23/02 166/192 |
| 2007/0221384 | A1 * | 9/2007 | Murray | E21B 23/02 166/376 |
| 2007/0261862 | A1 * | 11/2007 | Murray | E21B 23/02 166/386 |

* cited by examiner

SYSTEM FOR SUCCESSIVELY UNCOVERING PORTS ALONG A WELLBORE TO PERMIT INJECTION OF A FLUID ALONG SAID WELLBORE

CROSS-REFERENCE

This application is a continuation of U.S. patent application Ser. No. 15/805,721 filed Nov. 7, 2017, which is itself a continuation of U.S. patent application Ser. No. 15/137,961 filed on Apr. 25, 2016 (now U.S. Pat. No. 9,840,892), which claims the benefit of priority from Canadian Patent no. 2,904,470 filed Sep. 18, 2015, where U.S. Ser. No. 15/137,961 is a continuation-in-part of U.S. patent application Ser. No. 14/697,271 filed Apr. 27, 2015 (now U.S. Pat. No. 9,840,890), which is a continuation-in-part of U.S. patent application Ser. No. 14/505,384 filed Oct. 2, 2014 (now U.S. Pat. No. 9,587,464).

FIELD OF THE INVENTION

The present invention relates to multi-stage liners used in open hole or cased completions for injection of fluids at successive contiguous locations along a wellbore to create multiple fractures in a hydrocarbon zone along the wellbore.

BACKGROUND OF THE INVENTION

This background and documents mentioned below are provided for the purpose of making known information believed by the applicant to be of possible relevance to the present invention, and in particular allowing the reader to understand advantages of the invention over devices and methods known to the inventor, but not necessarily public. No admission is necessarily intended, nor should be construed as admitting, that any of the following documents or methods known to the inventor constitute legally citable prior art against the present invention.

After an oil or gas well is drilled within an underground hydrocarbon formation, the zones of interest need to be completed, namely conditioned typically by a fracking operation, in order to most quickly and to the greatest extent possible produce oil and/or gas from each particular zone. If the zone of interest requires a type of fracture stimulation, including but not limited to acid fracture or propped fracture, the zone of interest will be isolated to focus the fracture on the particular zone, and to prevent fracture in other zones which may not be desired.

Liner systems can be used prior to conducting the fracture stimulation and can be run in either open hole or cased hole applications.

In the stimulation of directional and horizontal wells, it can be desirable to treat multiple stages in a single zone, known as a cluster, with a single fracture stimulation. It can also be desirable to treat more than one zone with a single fracture stimulation to save time and expense associated with multiple treatments and time spent running tubing and tools in and out of the wellbore.

Various downhole tools and systems have been used to stimulate wells by permitting treatment/fracturing in multiple contiguous regions within a single zone. Many of such tools and systems require components within the bore of the liner at each valve which disadvantageously restricts flow of fluid through the liner during fracture pumping operations, and also, to the extent such systems or remnants thereof remain, similarly restrict production of hydrocarbons. Due to such flow restrictions, pressure drops occur, which result in less efficient operations as there is pressure loss incurred prior to the fracture fluid contacting the zone. Ideally, less pressure drop is desired to conduct a fracture stimulation more efficiently in each stage and in addition. In addition, such tools and methods require milling out of such components at each valve location prior to switching to production flow from the hydrocarbon bearing zones. It is desirous to have fewer materials/components to mill out within the bore liner immediately prior to commencing production from the hydrocarbon bearing zones.

Numerous patents and pending patent applications exist related to apparatus and systems for opening a plurality of ports in a liner within a wellbore at multiple contiguous locations therealong, to thereby permit injection of a fluid from such liner into a hydrocarbon formation, typically for the purpose of fracturing the formation at such locations.

For example, U.S. Pat. No. 8,215,411 teaches a plurality of opening sleeve/cluster valves along a liner for wellbore treatment, and utilizes a ball member or plug to open a sleeve at each valve thereby allowing fluid communication between the bore and a port in the sleeve's housing. This invention requires, however, a ball seat corresponding to each sleeve in a cluster valve, potentially restricting flow. The presence of a ball seat at each valve to be opened, due to the resulting bore restriction at each valve sleeve, creates a significant pressure drop across the cluster valve assembly.

U.S. Pat. No. 8,395,879 teaches a hydrostatically powered sliding sleeve. Again, such configuration utilizes a single ball, but each sliding sleeve configuration requires its own ball seat.

U.S. Pat. No. 4,893,678 discloses a multiple-set downhole tool and method that utilizes a single ball. Again, each valve requires a seat which is integral with a sliding sleeve, and which remains with each valve/port. When the sleeve/seat is forced by the ball to slide and thereby open the port, collet fingers may then move radially outwardly, disengaging the ball and allowing the ball to further travel downhole to actuate (open) further ports.

US Patent Application Publication No. 2014/0102709 discloses a tool and method for fracturing a wellbore that uses a single ball, each valve with a deformable ball seat. Again, each valve has a valve seat which remains with each valve/port.

Other patents and published applications avoid the problem of each valve/port having a ball seat which remains with each valve, and provide a dart or ball member which actuates a number of valves/ports. However, such designs are not without their own unique drawbacks.

For example, US 2013/0068484 published Mar. 21, 2013, inter alia in FIG. 6 thereof, (and likewise to same effect US 2004/0118564 published Jun. 24, 2004, likewise in FIG. 6 thereof) teaches an axially movable sliding sleeve 322 which is capable of actuating (i.e. opening) a number of downhole port sleeves 325a, 325b to thereby open corresponding respective downhole ports 317a, 317a' which are normally covered by port sleeve 325a, and similarly subsequently open respective downhole ports 317b, 317b' normally covered by port sleeve 325b. Sliding sleeve 322 is mounted by a shear pin 350 in the tubing string. Plug/ball 324 is inserted in the tubing, and uphole fluid pressure applied thereto cause plug 324 to travel downwardly in the in the string and abut sliding sleeve 322, further causing shear pin 350 to shear and thus sleeve 322 to then be driven downhole. Spring-biased dogs 351 on outer periphery of sliding sleeve 322 then engage inner profile 353a on sliding sleeve 325a and cause sleeve 325a (due to fluid pressure acting on plug 324) to move downhole thereby opening ports 317a, 317a'. As noted in paragraph [0071] therein, continued application of fluid pressure causes dogs 351 to collapse, thereby releasing sleeve 322 from engagement with inner profile 353a on sliding sleeve 325, and allowing sleeve 322 to further travel downhole and actuate (i.e. open) further sleeves in like manner. Although not expressly mentioned nor shown in US 2013/0068484, seals are necessary around dogs 351 in order to allow creation of a pressure differential when such continued application of fluid pressure is applied, in order to cause collapse of such dogs to allow disengagement with a first sleeve and allow the dart to thereafter further travel downhole for subsequent actuation of additional downhole sleeves and ports. The necessity for seals around dogs 351 necessarily introduces added mechanical complexity and the possibility of inability to release sleeve 322 from engagement if such seals were to leak due to the then-inability to create a pressure differential.

WO 2013/048810 entitled "Multizone Treatment System" published Apr. 4, 2013 teaches a system and method for successively opening flow control devises (which may be sliding sleeves) in a tubing string along a length thereof, commencing with a most downhole valve and opening a sleeve at such location, and by insertion of additional darts progressing successively upwardly in the tubing string to open further uphole sleeves. The tubing string is provided with a plurality of spaced apart flow control devices, such as sliding sleeves, each having an annulary-located recess therein with a unique profile relative to other flow control devices. A first dart, having an engagement feature sized to correspond with a selected annulary-located recess of a particular most-downhole flow control device, is injected, and such dart passes to actuate the flow control device to allow it to open a port. The process is progressively repeated for additional uphole flow control devices by injecting additional darts, having corresponding features to engage a selected flow control device. The darts are then drilled out to allow production from the tubing. Disadvantageously, only one dart can open one port, and thus a plurality of contiguously spaced ports are not capable of being opened by a single dart using such apparatus/method, thereby rendering such system/method time consuming.

CA 2,842,568 entitled "Apparatus and Method for Perforating a Wellbore Casing, and Method and Apparatus for Fracturing a Formation" published May 29, 2014 teaches inter alia dart members similar to the dart of WO 2013/048810, each dart having a protruding spring-biased profile uniquely sized to engage a similarly-sized annular recess on a plurality of downhole sliding sleeves, and thereby open sliding sleeve, with further means being provided on each of such sliding sleeves to allow the single dart member to further travel downhole and open additional sleeves having similar-sized annular recesses. No collet sleeve is provided, and a non-beveled (non-chamfered) surface on the annular recess of the most downhole sleeve is used to retain the dart from travelling further downhole. Disadvantageously, in comparison to the system as hereinafter described, the configuration of the dart, namely having a spring-biased profile and a cup seal thereon, essentially requires the dart to be virtually solid and thereby permanent obstruction to the wellbore once opening the last of a series of slidable sleeves. If additional uphole sleeves are desired to be actuated using a second dart (having a narrower protruding spring-biased profile than the first dart used), the first dart must be installed using a locator tool and thereafter retrieved, after actuating a plurality of sleeves and associated ports using such tool, as shown in FIGS. 9A-9D. Such a system involves use of extensive equipment from surface and the need of a bypass port that need by opened and closed to allow effective operation including insertion and withdrawal of the locator tool. These steps and features complicate the operation of such prior art system and add to expense and time.

A need exists for an effective and simpler system which does away with tools from surface for opening production tubing for use after actuation of such ports.

SUMMARY OF THE INVENTION

It is an object of the invention to provide an additional alternative system to existing systems and methods for opening contiguously spaced-apart ports located along a tubing within a wellbore to allow injection of fluid into a hydrocarbon formation.

It is a further object of the present invention, in certain embodiments thereof, to provide a system which may selectively open groups of continuous ports along a tubing liner separately, to allow separate and discrete fracking of various differently-located hydrocarbon zones which may exist along a length of a tubing liner within a wellbore in a hydrocarbon formation.

It is a still further object of the present invention to provide a system which can do each of the above, yet nevertheless provide a minimum restriction to the bore of the tubing liner to thereby maximize production and flow rate of hydrocarbon therefrom.

It is a still further object of certain embodiments of the present invention to be able to accomplish each of the foregoing objects, yet nonetheless not have to, after the completion of the opening of the ports and the fracking process, insert a reamer to ream out any remaining flow obstructions within the tubing liner, and thereby avoid additional steps prior to being able to produce hydrocarbons from a wellbore.

Accordingly, in a first broad embodiment, the present invention provides for a system for successively uncovering a plurality of contiguous spaced-apart ports along a wellbore, comprising:

(i) a tubular liner having a bore, further comprising:
  (a) a plurality of said spaced-apart ports longitudinally and contiguously spaced along said tubular liner;
  (b) a corresponding plurality of cylindrical sliding sleeve members, each longitudinally slidable within said bore, each configured in an initial closed position to overlap a corresponding of said ports, and when slidably moved to an open position to uncover said corresponding port, each of said sliding sleeve members having an interior circumferential groove therein;
  (c) a shear member, initially securing said slidable sleeve members in said initial closed position, and sheareable when a force is applied to a respective of said slidable sleeve members;

(ii) an actuation member positioned within said bore, comprising:
  (a) a cylindrical hollow collet sleeve, having a radially-outwardly biased and protruding protuberance, said protuberance configured to successively matingly engage each of said respective interior circumferential grooves on said sliding sleeve members, wherein said protuberance is of a substantially equal or lesser width than a width of said circumferential grooves on each of said sliding sleeve members, wherein said protuberance may be inwardly compressed to allow said collet sleeve and protuberance thereon to become disengaged from mating engagement in said circumferential groove;

(b) a plug member, situated within said collet sleeve and when in a first position situated at an uphole end thereof, which at least for a limited time together with said collet sleeve substantially obstructs passage of fluid within said bore when said collet sleeve and plug member are together situated in said bore;

(c) a shear pin, releasably securing said plug member to an uphole end of said collet sleeve, shearable when a force is applied to said plug member to cause said plug member to move downhole in said collet sleeve to a second position therein preventing said protuberance from thereafter being forcibly inwardly compressed and thereby maintaining said protuberance in mating engagement with said circumferential groove;

wherein fluid pressure applied to an uphole end of said actuation member causes said actuation member to move downhole and successively engage said circumferential groove in each of said sliding sleeve members and move said sliding sleeve members downhole so as to thereby uncover each of said plurality of ports;

wherein fluid pressure required to shear said shear members in all of said slidable sleeve members save and except for a most-downhole of said slidable sleeve members, is less than fluid pressure required to shear said shear pins securing said plug member to said uphole end of said collet sleeve; and wherein said plug member, when opening a most-downhole sliding sleeve member, shears said shear pin therein and moves downhole in said collet sleeve from said first position therein to said second position thereby preventing said protuberance from being inwardly compressed.

In a further refinement, the tubing liner is further provided with burst plates covering each of said ports, said burst plates adapted to rupture and allow fluid communication from said bore to said port upon a fluid pressure in said bore being higher than and exceeding the fluid pressure necessary to:

(i) cause said plug member and collet sleeve to shear said shear member; and (ii) cause said plug member to shear said shear pin and move to said plug member to said second position.

In a still further refinement, the plug member is dissolvable, and after moving to said second position and after a period of time being exposed to fluid within said bore, becomes dissolved. Such advantageously avoids having to insert a downhole reamer within the tubing liner, once fluid injection into the formation via the opened ports has been completed, in order to ready the tubing liner for production so as to allow hydrocarbons from locations further downhole to flow uphole to surface.

In a further refinement of the aforementioned system, means is provided to lock the sliding sleeves in the open position once such sliding sleeves have been moved by the plug and collet sleeve to the open position uncovering such ports. Thus in a preferred embodiment, a snap ring member is provided with each of said plurality of sliding sleeve members, which snap ring member locks each sliding sleeve member in said open position when said sliding sleeve member is moved to said open position. Other similar means of locking each sliding sleeve in an open position will now occur to persons of skill in the art, and are likewise alternatively contemplated for use in the system of the present invention to lock the sliding sleeves in the open position.

In a still further refinement, the plug member upon movement to said second position prevents said protuberance from being inwardly compressed, and said actuation member is further prevented along from further movement downhole.

In a further preferred embodiment, a plurality of actuation members, each comprised of a collet sleeve having a protuberance thereon of a different with, are utilized to uncover a plurality of groups of discrete/separate spaced apart ports, wherein each of the groups of ports in the liner are positioned in different zones of the formation. Such allows injection of fluid in separate zones of the wellbore, at a time and in a sequence determined by the completions engineer who controlling the fracking/completion process to be most optimal for allowing greatest recovery from the well.

Accordingly, in such further preferred embodiment of the system of the present invention, a system for successively uncovering at least two separate groups of contiguous spaced-apart ports along a wellbore is provided, comprising:

(i) a tubular liner having a bore, further comprising:

(a) a plurality of first spaced-apart ports longitudinally spaced along said tubular liner;

(b) a corresponding plurality of first cylindrical sliding sleeve members, each longitudinally slidable within said bore, each configured in an initial closed position to overlap a corresponding of said first ports and when slidably moved to an open position to not overlap said first port, each of said sliding sleeve members having an interior circumferential groove therein of a first width;

(c) a plurality of said second spaced-apart ports longitudinally and contiguously spaced along said tubular liner, situated in said tubular liner downhole from said first ports;

(d) a corresponding plurality of second cylindrical sliding sleeve members, each longitudinally slidable within said bore, each configured in an initial closed position to overlap a corresponding of said second ports and when slidably moved to an open position to not overlap said corresponding second port, each of said second sliding sleeve members having an interior circumferential groove therein of a second width, wherein said second width is greater than said first width;

(e) shear members, respectively securing said first and second slidable sleeve members in said initial closed position, and shearable when a force is applied to a respective of said first and second slidable sleeve members;

(ii) a first actuation member positioned within said bore, comprising:

(a) a cylindrical hollow collet sleeve, having a plurality of elongate longitudinally extending finger members thereon, said finger members having thereon a radially-outwardly protruding protuberance, said protuberance configured to successively matingly engage said respective interior circumferential groove on each of said second sliding sleeve members, wherein said protuberance is of a width substantially equal to said second width but greater than said first width, wherein said protuberance may upon fluid pressure being applied to an uphole side of said first actuation member be inwardly compressed to allow said collet sleeve and protuberance thereon to become disengaged from mating engagement in said circumferential groove in each of said second sliding sleeve members;

(b) a plug member, situated within said collet sleeve and when in a first position situated at an uphole end of said collet sleeve, which at least for a limited time together with said collet sleeve substantially obstructs passage of fluid within said bore when said collet sleeve and plug member are together situated in said bore;

(c) a shear pin, releasably securing said plug member to an uphole end of said collet sleeve, shearable when a force is applied to said plug member to cause said plug member to move downhole in said collet sleeve to a second position therein preventing said finger members from thereafter being forcibly inwardly compressed and thereby maintaining said protuberance in mating engagement with said circumferential groove;

wherein fluid pressure applied to an uphole end of said first actuation member causes said first actuation member to move downhole and cause said collet sleeve thereof to successively engage said second circumferential groove in each of said second slidable sleeve members and move each of said second sliding sleeve members downhole so as to thereby uncover each of said plurality of second ports;

wherein fluid pressure required to shear said shear members in all of said second slidable sleeve members save and except for a most-downhole of said slidable sleeve members, is less than fluid pressure required to shear said shear pins securing said plug member to said uphole end of said collet sleeve; and wherein said plug member in said first actuation member, when opening a most-downhole second sliding sleeve member, shears said shear pin therein and moves downhole in said collet sleeve from said first position therein to said second position thereby preventing said protuberance from being inwardly compressed;

said system further comprising:

(iii) a second actuation member positioned within said bore, comprising:

(a) a cylindrical hollow collet sleeve, having a plurality of elongate longitudinally extending finger members thereon, said finger members having thereon a radially-outwardly protruding protuberance, said protuberance configured to successively matingly engage said respective interior circumferential groove on each of said first sliding sleeve members, wherein said protuberance is of a width substantially equal to said first width, but less than said second width, wherein said protuberance may be inwardly compressed to allow said collet sleeve and protuberance thereon to become disengaged from mating engagement in said first circumferential groove in each of said first sliding sleeve members;

(b) a plug member, situated within said collet sleeve and when in a first position situated at an uphole end of said thereof, which at least for a limited time together with said collet sleeve substantially obstructs passage of fluid within said bore when said collet sleeve and plug member are together situated in said bore;

(c) a shear pin, releasably securing said plug member to an uphole end of said collet sleeve, shearable when a force is applied to said plug member to cause said plug member to move downhole in said collet sleeve to a second position therein preventing said finger members from thereafter being forcibly inwardly compressed and thereby maintaining said protuberance in mating engagement with said circumferential groove;

wherein fluid pressure applied to an uphole end of said second actuation member causes said second actuation member to move downhole and said collet sleeve thereof successively engage said circumferential grooves in each of said first slidable sleeve members and move each of said first sliding sleeve members downhole so as to thereby uncover each of said plurality of first ports; and wherein fluid pressure required to shear said shear members in all of said first slidable sleeve members save and except for a most-downhole of said first slidable sleeve members, is less than fluid pressure required to shear said shear pins securing said plug member to said uphole end of said collet sleeve.

In a further embodiment the plug member in said second actuation member, when opening a most-downhole sliding sleeve member, shears said shear pin therein and moves downhole in said collet sleeve from said first position therein to said second position thereby preventing said protuberance from being inwardly compressed.

In a still further embodiment, the plug member in the second actuation member and/or first actuation member may be dissolvable by a fluid that may be injected downhole.

In a further refinement burst plates may likewise be provided covering each of said first and second ports, said burst plates adapted to rupture and allow fluid communication from said bore to said port only upon a fluid pressure in said bore exceeding:

(i) the fluid pressure necessary to cause said plug member in each of said first and second actuation member and said associated collet sleeve to shear said shear member; and (ii) the fluid pressure necessary to cause said plug member in each of said first and second actuation member to shear said shear pin and move to said plug member to said second position in each collet sleeve.

In such manner, as fracking operations are typically conduced commencing with a most downhole/furthest extremity of the wellbore, the wellbore may be progressively fracked in each zone, commencing from the most downhole/furthest extremity of the wellbore.

In a further embodiment of the present invention, the invention provides a system using at least two actuating (slidable dart) members, each of said at least two actuating members having a differently-dimensioned (or differently-configured) protuberance profile, so that the protuberance profile on a collet sleeve of each of the actuation members is unique. A first of such actuation members having such a unique protuberance profile successively matingly engages at least one sliding sleeve member, and preferably successively matingly engages a first group of sliding sleeve members, all having a similarly configured inner circumferential groove or series of grooves thereon which matingly engage the protuberance profile on the actuation member, to allow the actuation member to thereby uncover/open a series of ports along a hollow tubular member. A plug member, typically a spherical ball pumped down the tubular liner, obstructs the flow of fluid through each actuation member, thereby providing a downhole motive force on each of said at least two actuation members. After opening, by a first of the at least two actuation members, at least one port and preferably a group of ports, a second actuation member having a differently configured or dimensioned profile, can be pumped downhole to then similarly move and thereby open a second group of sliding sleeve members, so as to allow opening at a different time of a second group of ports along a tubular liner.

As many groups of ports may be individually opened as there are actuation members having different configured/dimensioned protuberance profiles.

In such further embodiment, it is not necessary that the plug member, typically in this embodiment a spherical ball, be affixed via shear pins to the collet sleeve of the actuation member.

Accordingly, in a first broad embodiment of such further embodiment a system for successively uncovering at least two separate groups of contiguous spaced-apart ports along a pipe inserted in a wellbore is provided. Such system comprises:

(i) a tubular liner having a bore, further comprising:
  (a) a plurality of said spaced-apart ports longitudinally and contiguously spaced along said tubular liner;
  (b) a corresponding plurality of cylindrical sliding sleeve members, each of said sleeve members associated with a respective of said plurality of spaced-apart ports, each sliding sleeve member longitudinally slidable within said bore and configured in an initial closed position to overlap a corresponding of said ports, and when slidably moved to an open position to uncover a corresponding of said ports, each of said sliding sleeve members having an interior circumferential groove, a width of said interior circumferential groove in said sliding sleeve members associated with a first group of contiguous spaced-apart ports being different than a width of said interior circumferential grooves in said sliding sleeve members associated with a second group of contiguous spaced-apart ports;
  (c) a shear member, initially securing said slidable sleeve members in said initial closed position, and sheareable when a force is applied to a respective of said slidable sleeve members;

(ii) a first actuation member positioned within said bore, comprising:
  (a) a cylindrical hollow collet sleeve, having a radially-outwardly biased and protruding profile, said profile configured to matingly engage said interior cylindrical grooves in said sliding sleeves associated with a first of said at least two groups of ports, but not matingly engage said interior cylindrical grooves associated with sliding sleeve members which initially cover said second group of ports;
  (b) a dissolvable plug member, dimensioned so as to be positionable and remain lodged within said collet sleeve of said first actuation member at an uphole end thereof, which at least for a limited time when not dissolved together with said collet sleeve substantially obstruct passage of a fluid within said bore when said collet sleeve and dissolvable plug member are together situated in said bore, and becomes dissolved after said fluid is injected down said wellbore;
  wherein fluid pressure applied to an uphole end of said first actuation member causes said first actuation member to move downhole and engage said circumferential groove in said at least one sliding sleeve member associated with said first group of ports, and not engage said circumferential grooves of a different width in remaining cylindrical sliding sleeve members associated with said second group of ports, and move each sliding sleeve member associated with said first group of ports downhole so as to thereby uncover said ports in said first group of ports; and (iii) a second actuation member positioned within said bore, comprising:
  (a) a cylindrical hollow collet sleeve, having a radially-outwardly biased and protruding profile, said profile configured to matingly engage said interior cylindrical grooves in said sliding sleeves associated with a second of said at least two groups of ports;
  (b) a dissolvable plug member, dimensioned so as to be positionable and remain lodged within said collet sleeve of said second actuation member at an uphole end thereof, which at least for a limited time when not dissolved together with said collet sleeve substantially obstructs passage of a fluid within said bore when said collet sleeve and dissolvable plug member are together situated in said bore, and becomes dissolved after said fluid is injected down said tubular liner;
  wherein fluid pressure applied to an uphole end of said dissolvable plug member upon a fluid being injected down said tubular liner, causes said second actuation member to move downhole and engage said circumferential groove in said at least one sliding sleeve members associated with said second group of ports, and move each sliding sleeve member associated with said second group of ports downhole so as to thereby uncover said ports in said second group of ports.

As noted above, such system is particularly adapted for successively uncovering at least two separate groups of contiguous spaced-apart ports along a tubular liner. Preferably, the interior grooves and/or said resiliently outwardly biased profile on said first and/or second actuation members are provided with a chamfer so as to permit, after said profile on said first and second actuation members has matingly engaged a respective of said interior circumferential grooves, said profile on said first and/or second actuation member to be released from said mating engagement therein upon further fluid pressure being applied uphole to said plug member, so as to allow the first and/or second actuation member to move further downhole and actuate (i.e. open) additional desired ports along such tubing liner.

In a preferred refinement of such further embodiment, each of sliding sleeve members at a lowermost (downhole) end thereof, possess radially-outwardly biased and extending tab members which engage an aperture in said tubing liner when a respective of said sliding sleeve members is moved to uncover an associated port, which tab members when engaged in said aperture prevent respective of said sliding sleeve members from moving uphole to thereby close an associated port.

In a further refinement, said first and second actuation members are provided, at a downhole end thereof, with an annular ring of a diameter substantially equal to the diameter of the sliding sleeve members, having a chamfer thereon to assist said actuation member in moving downhole in the tubular liner.

In a further refinement, one or both of said first or second actuation members may be dissolvable upon being exposed for a period of time to said fluid. Such a configuration advantageously eliminates, after the opening of ports along the tubular liner, any remaining restriction in the diameter of the tubing liner, and allows as much cross-sectional area of the tubing liner to be utilized for producing oil collected in such tubing liner after fracking via the opened ports. Horsepower pumping requirements, due to the reduced restrictions inherent in the tubing liner when producing, are thereby reduced to the maximum possible for a given tubing liner diameter.

In a further embodiment of the present invention, the invention relates to a method for successively uncovering a plurality of spaced-apart ports along a hollow tubular liner. Such method comprises the steps of:

(i) injecting a first actuation member having a profile thereon of a first width down said tubular liner having a plurality of sliding sleeve members respectively covering a corresponding plurality of said spaced-apart ports along said tubular liner;

(ii) causing said profile on said first actuation member to engage an interior circumferential groove on a lowermost of said sliding sleeve members, and upon application of fluid pressure uphole of said first actuation member, causing said sliding sleeve member to move downhole and thereby uncover an associated of said ports in said tubular liner;

(iii) allowing fluid in said tubular liner to dissolve a plug in said first actuation member so as to allow flow of fluid in said tubular liner through said first actuation member;

(iv) injecting a further actuation member down said tubular liner having a profile thereon of a lesser width;

(v) causing said profile of said lesser width thereon to engage an interior circumferential groove on a sliding sleeve member uphole of said lowermost sliding sleeve member, and upon application of fluid pressure uphole of said further actuation member, causing said uphole sliding sleeve member to move downhole and thereby uncover an additional associated of said ports in said tubular liner;

(vi) allowing fluid in said tubular liner to dissolve a plug in said further actuation member so as to allow flow of fluid in said tubular liner through said further actuation member; and (vii) repeating steps (iv)-(vi) until all of said plurality of spaced-apart ports along said tubular liner have been opened.

The above summary of the invention does not necessarily describe all features of the invention. For a complete description of the invention, reference is to further be had to the drawings and the detailed description of some preferred embodiments, read together with the claims.

BRIEF DESCRIPTION OF THE DRAWINGS

Further advantages and other embodiments of the invention will now appear from the above along with the following detailed description of the various particular embodiments of the invention, taken together with the accompanying drawings each of which are intended to be non-limiting, in which:

FIGS. 1A-1D show a series of sequential views of a tubing liner incorporating the system of the present invention, with:

FIG. 1A is an initial view showing the tubing liner with the ports and corresponding sleeves in the closed position;

FIG. 1B is a subsequent view showing the tubing liner with the actuation member inserted in the liner and the collet sleeve and protuberances thereon engaging the first sliding sleeve member;

FIG. 1C is a subsequent view showing the actuation member having moved the most uphole sliding sleeve member so as shear the shear members and force the associated sliding sleeve member to move downhole so as to thereby uncover its associated port, such actuation member having disengaged from such sliding sleeve member and in the process of moving further downhole to similarly open a further downhole sliding sleeve member and associated port; and FIG. 1D is a subsequent view showing the actuation member having engaged the more downhole sliding sleeve member and having sheared the associated shear members thereof and having moved such sleeve member downhole so as to likewise uncover its associated port, with the plug member having further sheared its retaining shear pins and moved downhole within the collet sleeve thereby preventing the protuberances on the collet sleeve from disengaging from the associated sliding sleeve member and the plug member and associated collet sleeve being further prevented from moving further downhole;

FIGS. 2A-2D show a series of sequential views of a tubing liner incorporating a further refinement of the system of the present invention, namely comprising two different types of sliding sleeve members intended to be separately actuated by different actuation members, with:

FIG. 2A showing a tubing liner with the ports and corresponding sleeves in the closed position, and in particular with two types of sliding sleeve members, a first group thereof (the most uphole slidable sleeve member shown) having a circumferential groove of lesser width than the circumferential groove in adjacent downhole sliding sleeve members, and showing the tubing liner with the actuation member inserted in the liner and the collet sleeve and protuberances thereof having passed the first sliding sleeve member and continuing downhole in the liner;

FIG. 2B is a subsequent view of the tubing liner showing the actuation member having moved past the most uphole sliding sleeve member within the tubular liner, and moved downhole to the second sliding sleeve member of the second group of slidable sleeves, wherein protuberances on the collet sleeve thereof having engaged the corresponding circumferential groove on such second sliding sleeve member;

FIG. 2C is a subsequent view showing the actuation member having sheared the shear members initially retaining the second slidable sleeve member, and having moved such slidable sleeve member downhole so as to thereby uncover its associated port, and such actuation member having disengaged from such second sliding sleeve member and in the process of moving further downhole; and FIG. 2D is a subsequent view showing the actuation member having engaged the most downhole sliding sleeve member and having sheared the associated shear members thereof and having moved such sleeve member downhole so as to likewise uncover its associated port, with the plug member having further sheared its retaining shear pins and moved downhole within the collet sleeve thereby preventing the protuberances on the collet sleeve from disengaging from the associated sliding sleeve member and the plug member and associated collet sleeve being further prevented from moving further downhole;

FIGS. 4-8 show enlarged successive views of a most downhole sliding sleeve member and associated port when acted on by an actuation member, wherein:

FIG. 4 shows an actuation member having been placed in the tubing liner, and such actuation member approaching the most-downhole sliding sleeve member;

FIG. 5 shows the actuation member having engaged the circumferential groove(s) in the most-downhole sliding sleeve member;

FIG. 6 shows the plug member having sheared the shear pins retaining it in the uphole end of the collet sleeve, and the plug member having moved to the downhole end of the collet sleeve thereby preventing disengagement of the collet fingers with the circumferential groove;

FIG. 7 shows the collet sleeve and plug member having sheared the shear members retaining the slidable sleeve member in a closed position, and having moved the slidable sleeve member to the open position;

FIG. 8 shows the most downhole sleeve in the open position, with the plug member having dissolved:

DETAILED DESCRIPTION OF SOME PREFERRED EMBODIMENTS

Figures 1A, 1B, 1C, 1D:
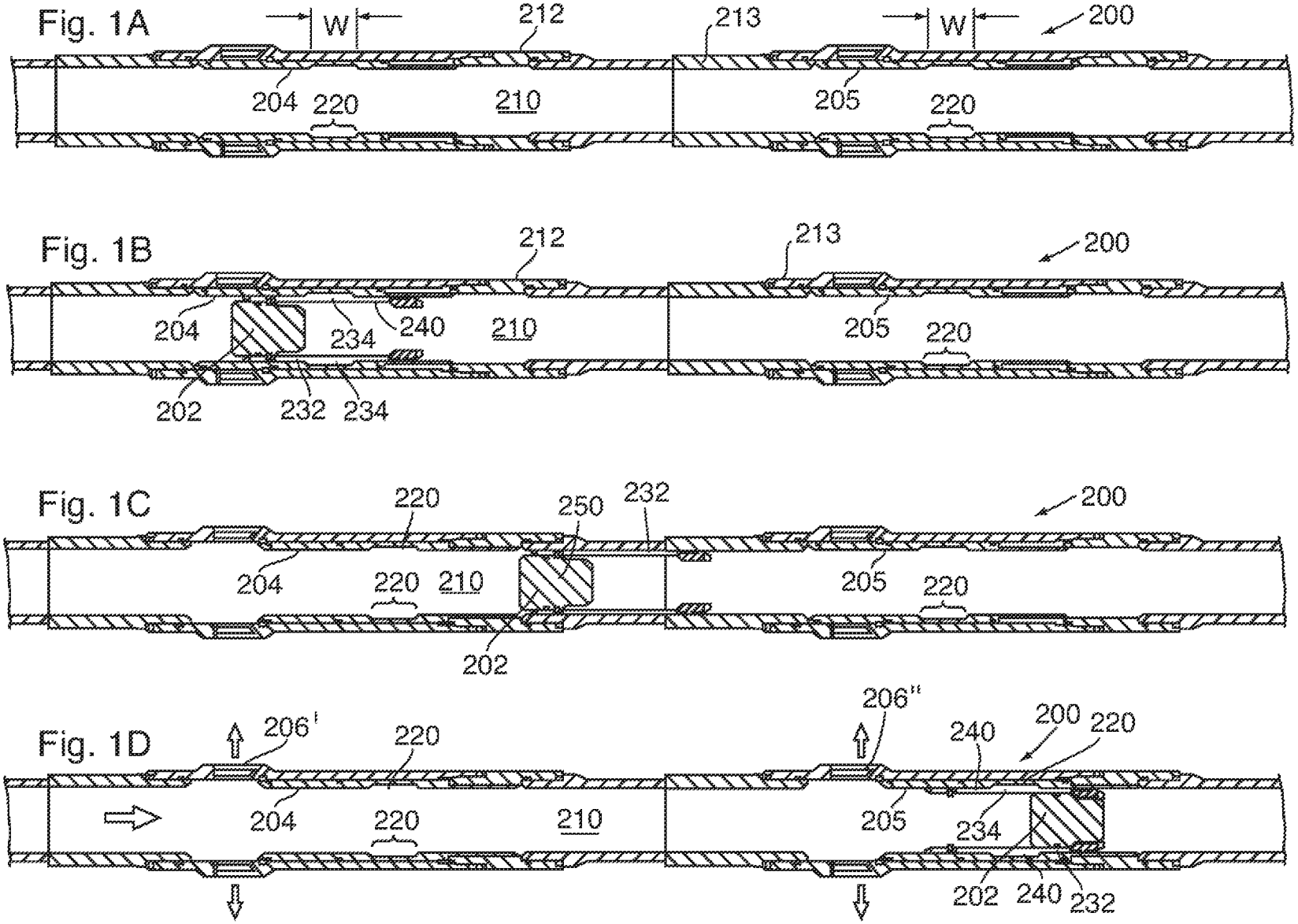

In the following description, similar components in the drawings are identified with corresponding same reference numerals.

The system of the present invention is to be used in the conditioning of a wellbore (i.e. "completion" of a wellbore in oilfield parlance) prior to production of hydrocarbons from such wellbore.

Specifically, the present system can advantageously be used to provide and allow the injection of pressurized fluid into a hydrocarbon-bearing formation at desired optimal locations along the wellbore, for the purposes of initially fracturing the hydrocarbon formation and/or injecting flow-enhancing agents into the formation (such as acids, flow enhancing agents, and/or proppants) all for the purpose and objective of increasing the rate and quantity of hydrocarbons to be subsequently recovered from the hydrocarbon formation.

A tubing liner 200 inserted into a drilled wellbore serves a variety of purposes, one of which is the reinforcement of the wellbore and preventing collapse of the wellbore, another of which is to allow supply of such completion fluids under pressure to desired zones of the hydrocarbon formation, via ports situated longitudinally in spaced-apart relation along the tubing liner.

FIG. 1A shows a portion of a tubing liner 200 for insertion into a drilled horizontal wellbore (not shown), incorporating portions of the system of the present invention.

Tubing liner 200 is typically constructed of segments of steel pipe members 211, 212. 213 each of uniform length threadably coupled together at their respective ends. Pipe members 211, 212, 213 are typically manufactured in various standardized lengths, widths, thicknesses, and material strengths, depending on the wellbore depth, diameter, pressures to which the tubing liner 200 will be exposed to, and the like. Tubing liners 200 typically contain a bore 210, and further possess a plurality ports, such as ports 206, 206', 206", which in certain conditions are permitted to fluidly communicate with bore 210. Ports 206, 206', 206" are initially closed during insertion of the tubing liner 200 into a wellbore, in order to avoid ingress into the bore 210 of detritus such as residual drill cuttings typically present in a wellbore which would otherwise clog ports 206, 206' and/or bore 210 thereby preventing collection of hydrocarbons in the tubing liner and/or preventing production of such hydrocarbons to surface.

FIGS. 1B-1D show the same tubing liner 200 in combination with an actuation member 202, which actuation member 202 is used to open selective ports 206, 206' in the manner hereinafter explained. FIGS. 1B-1D respectively depict the successive manner of operation of the actuation member 202 on the plurality of sliding sleeve members 204, 205 in the tubing liner 200 to successively open associated ports 206, 206' in tubing liner 200. Such components together broadly comprise the system of the present invention.

As may be seen from all figures herein, hollow cylindrical sliding sleeve members 203, 204, 205 are provided within tubing liner 200, initially each in a closed position overlapping and thereby covering respective ports 206, 206', 206" thus preventing fluid communication between bore 210 and any of ports 206, 206', 206". Each of sliding sleeve members 203, 204, 205 is provided with a circumferential groove or aperture 220, of a uniform width 'W' as shown in FIGS. 1A-1D. Alternatively, in a further refinement of the present invention as more fully explained herein, groups of sliding sleeve members possess circumferential grooves 220 of a given uniform width 'W1', whilst other groups of sliding sleeves possess circumferential grooves 220 of a greater uniform width 'W2', as shown in FIGS. 2A-2D herein.

Shear members, which in one embodiment comprise shear screws or shear pins 222, are provided to secure, at least initially, each of sliding sleeve members 203, 204, 205 to tubing liner 200, to thereby secure each of sleeve members 203, 204, 205 in an initial closed position overlapping each of respective ports 206, 206', 206". Shear screws 222 are configured to shear upon a force being applied to the respective sliding sleeve members 203, 204, 205 exceeding a given design value, so as to allow slidable downhole movement of sleeve members 203, 204, 205 to uncover a respective ports 206, 206', 206".

To operate the system of the present invention and open a single group of contiguous, spaced-apart ports 206', 206" as shown in FIGS. 1A-1D, an actuation member 202 is provided, positionable within bore 210. Actuation member 202 comprises a cylindrical hollow collet sleeve 232. Collet sleeve 232 possesses at least one radially-outwardly protruding and outwardly-biased protuberance 234. In a preferred embodiment the collet sleeve 232 possesses a plurality of elongate longitudinally extending and radially outwardly biased finger members 240 thereon, with each finger member 240 having thereon said radially-outwardly protruding protuberance 234.

Protuberance 234 is configured of a width equal to or slightly less than width 'W" of circumferential groove 220, to thereby allow matingly engagement with each of respective interior circumferential grooves 220 in each of sliding sleeve members 206', 206". Finger members 240, being radially outwardly biased, may be inwardly compressed to allow collet sleeve 232 and associated protuberances 234 to become radially inwardly compressed to thereby allow disengagement of collet sleeve 232 and protuberance 234 from a respective sliding sleeve member and associate groove 220, once the respective sliding sleeve member 204, 205 is moved so as to uncover respective port 206', 206", to thereby allow actuation member 202 to continue to move downhole and further actuate (open) all desired remaining sliding sleeve members 204, 205 having circumferential grooves 220 therein of width 'W".

A plug member 250 is provided within collet sleeve 232 of actuation member 202. Plug member 250 is initially secured by shear pins 275 to collet sleeve 232 at an uphole end of collet sleeve 232, as shown for example in FIGS. 1B, 1C, 2B, 2C, and FIG. 5. Of note, all instances of use of the term "shear pin" herein in this application means and includes any shear screw, shear pin, frangible weld or solder connection initially securing plug member 250 to uphole end of collet sleeve 232.

Shear pins 275, when a fluid pressure is applied on an uphole side of plug member 250 in excess of a given value, are adapted to shear so as to release plug member 250 from being secured to the uphole side of collet sleeve 232 and to then travel downhole within collet sleeve 232 to a downhole portion of collet sleeve 232, where further movement of plug member 250 is prevented by an extremity (a chamfered shoulder 255) of collet sleeve 232.

Figures 2A, 2B, 2C, 2D:
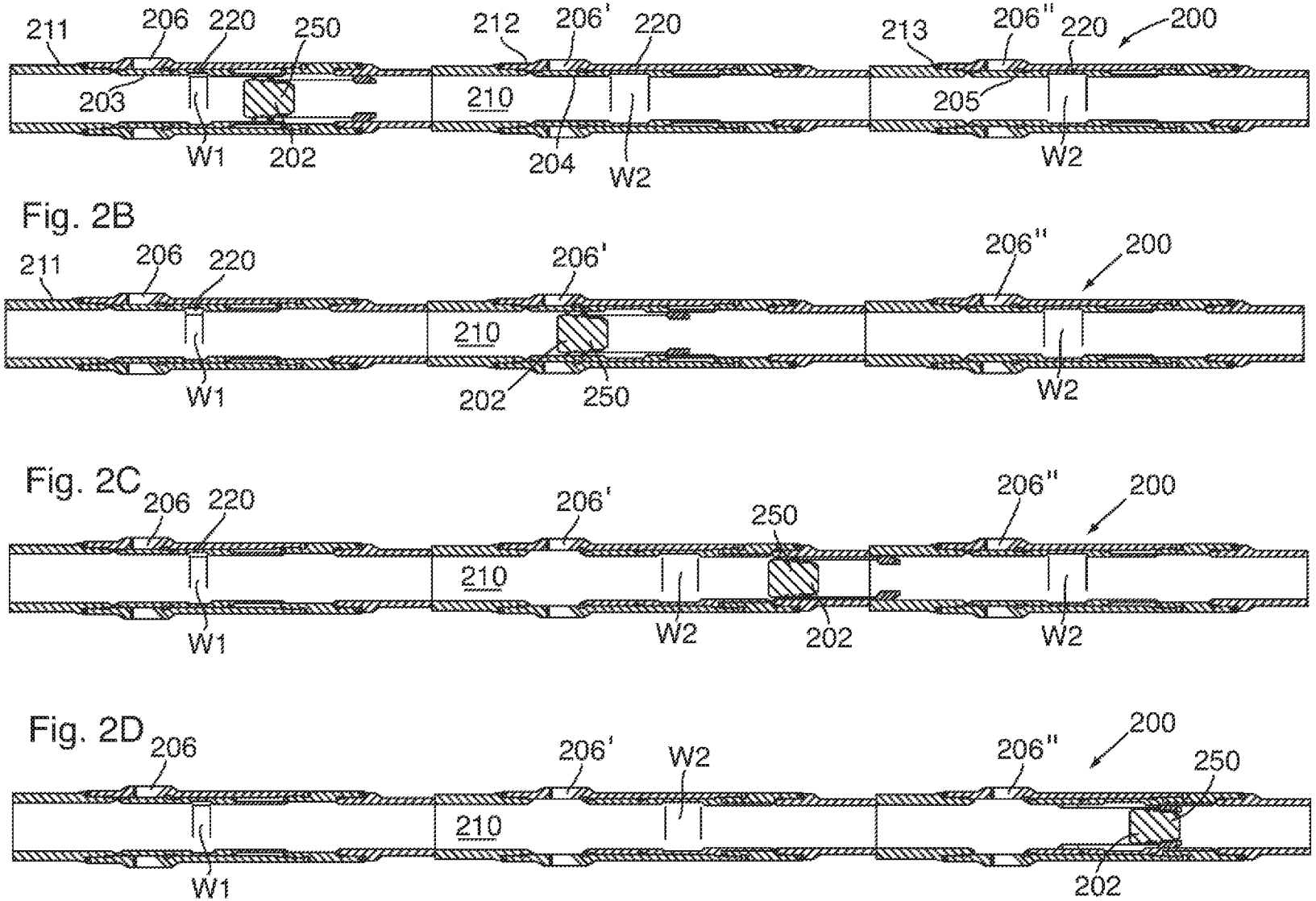

Fluid pressure applied to an uphole end of said actuation member 202 and plug member 250 causes collet sleeve 232 to move downhole, as shown in successive FIGS. 1B-1D, and in successive figures FIGS. 2B-2D, and engage circumferential grooves 220 in respective downhole sliding sleeve members 204, 205 and successively move sliding sleeve members 204, 205 downhole so as to thereby uncover each of corresponding ports 206', 206".

The fluid pressure required to shear said shear members 222 securing slidable sleeve members 204 is less than the fluid pressure required to shear said shear pins 275 securing said plug member 250 to said uphole end of said collet sleeve 232, save and except for the fluid pressure required to shear the shear members 220 securing the most downhole sliding sleeve member 205.

Figure 6:
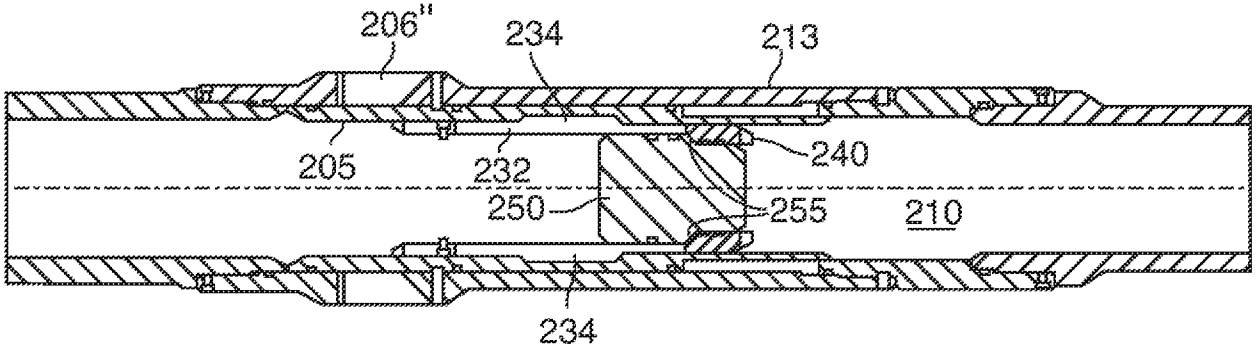

Accordingly, when opening a most-downhole sliding sleeve member 205, due to the higher shearing strength in shearing members 222 than shear pins 275, plug member 250 firstly shears shear pin 275 therein and thereby allows plug member 250 to move downhole in collet sleeve 232 from the first uphole position (FIG. 5) in collet sleeve 232 to the second position (ref. FIG. 6) where it is restrained by chamfered shoulders 255 on plug member 250. Movement of plug member 250 to the second position (ref. FIG. 1D and FIG. 6) thereby prevents protuberances 234 from being inwardly compressed Application of additional uphole fluid pressure acting on the plug member 250 then causes shearing members 222 securing most downhole sliding sleeve member 205 to shear, thus allowing the most downhole sliding sleeve to move downhole and thereby uncover the most downhole port 206" in the series of ports 206', 206".

In the system shown in FIGS. 1A-1D, and also for a system where individual discrete groups of ports are provided which are desired to be opened separately, for example uphole first ports 206 and a second downhole group of (second) ports 206', 206" and each of said first ports 206 and second ports 206', 206" are desired to be opened separately as shown in FIGS. 2A-2D, burst plates 300 may be provided which cover each of ports 206, 206', and 206. Burst plates 300, as shown in FIGS. 1A-1D, are adapted to rupture and allow fluid communication from bore 210 to a respective port 206', 206" when fluid pressure in bore 210 (*i*) exceeds the fluid pressure necessary to cause plug member 250 and collet sleeve 232 to shear the shear members 222, including the most downhole of the shear members 220 securing the most downhole sliding sleeve 205; and (ii) when the fluid pressure in bore 210 also exceeds the fluid pressure necessary to cause plug member 250 to shear the shear pins 275 and move plug member 250 to the second downhole position in collet sleeve 232. Burst ports 300 covering such first group of ports 206 may be provided with a different burst pressure than burst ports 300 covering ports 206', 206". In particular, when first ports 206 are located uphole of second ports 206', 206" as shown in FIGS. 2A-2D, burst plates covering second ports 206', 206" may have a lower burst pressure than burst ports covering uphole first ports 206.

FIGS. 2A-2D show the embodiment of the system discussed immediately above, namely were individual discrete groups of ports are provided, namely first ports 206 and second ports 206', 206" where each of said first ports and second ports 206', 206" are desired to be opened separately, but without burst plates 300 being provided.

Figure 3A:
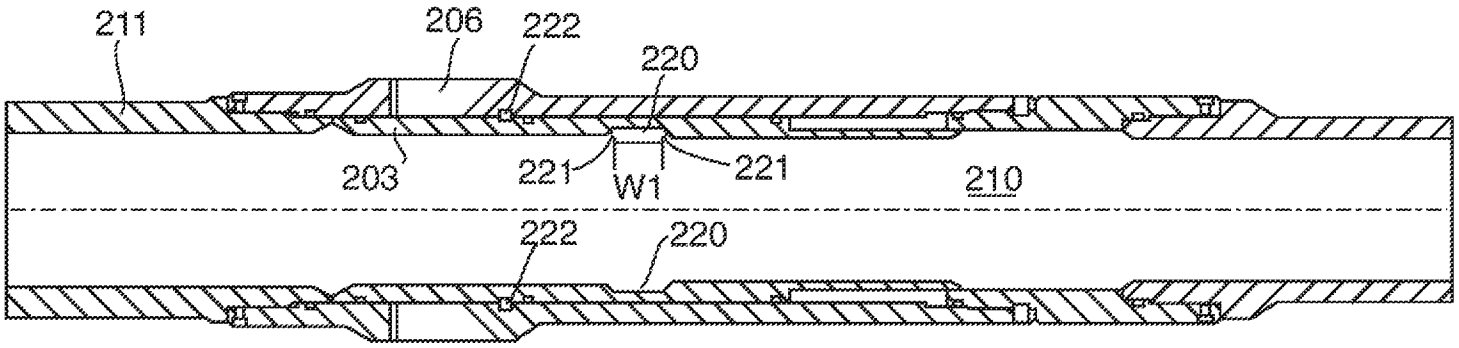
FIG. 3A-3B show two different types of sliding sleeve members-a first type as shown in FIG. 3A having a circumferential groove of width W1, and a second type as shown in FIG. 3B having a circumferential groove of width W2.
Figure 3B:
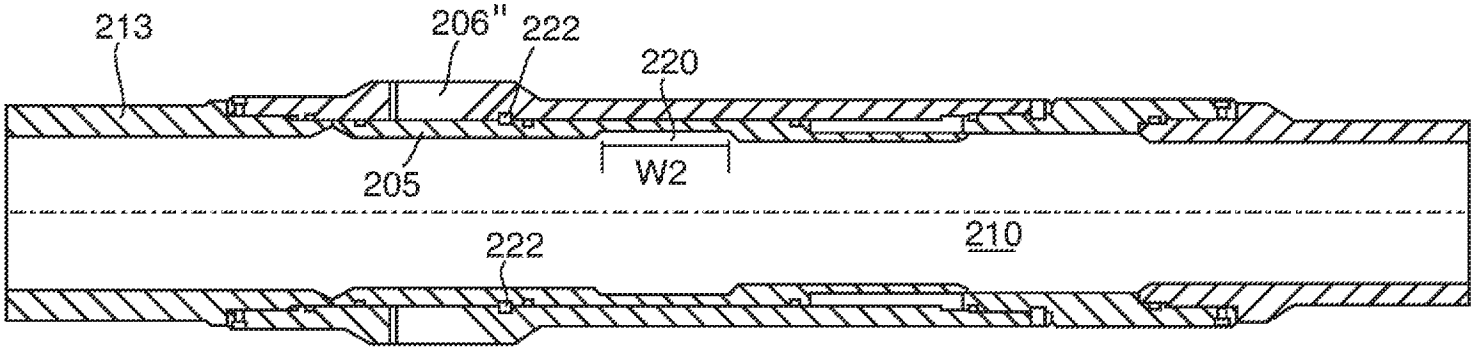
Figure 4:
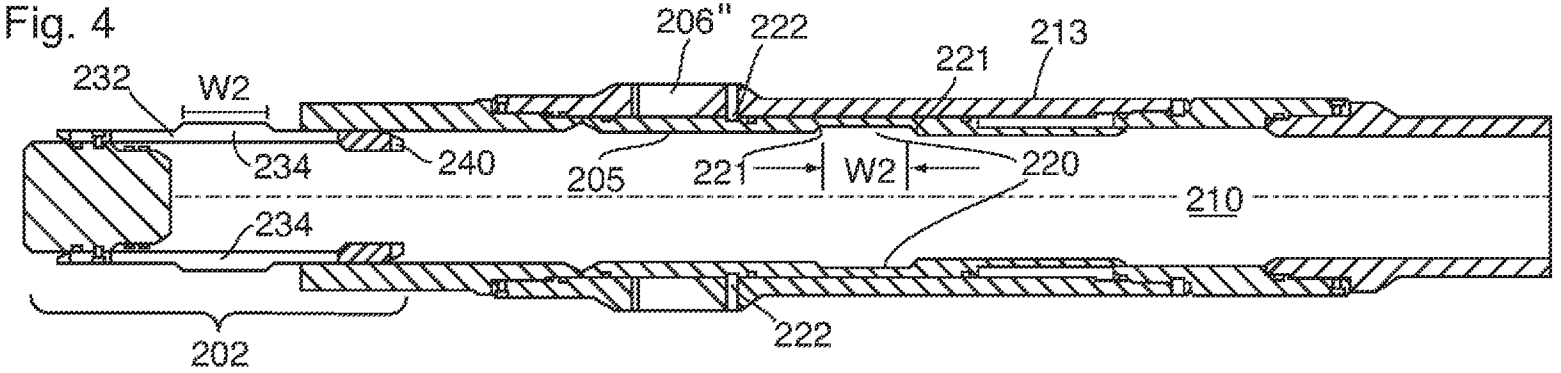
Figure 5:
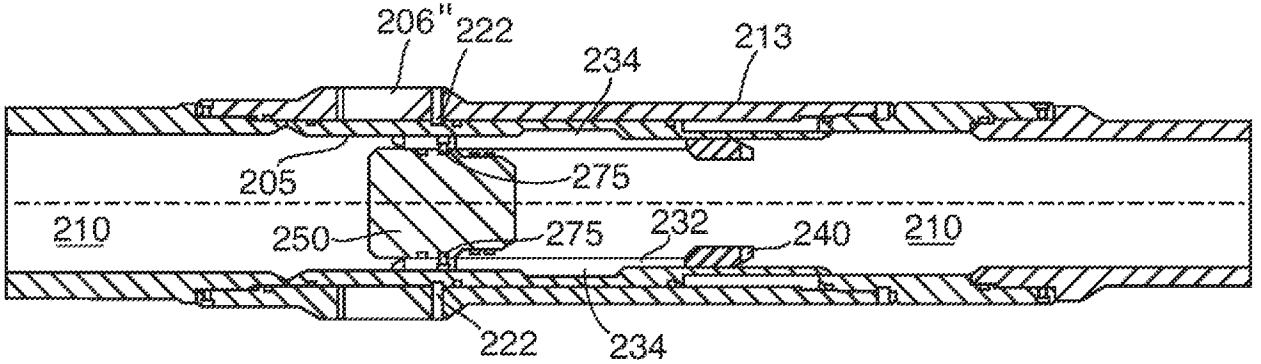

In such embodiment, a series/group of first uphole sleeve members 203, as shown in FIGS. 2A-2D and as best shown in enlarged view in FIG. 3A, are provided. Each of first ports 206 have an associated sliding sleeve member 203 which in a closed position overlaps port 206 preventing fluid communication with bore 201. Uphole sliding sleeve member 203 possesses a circumferential groove 220 of width W1, adapted to be matingly engaged by a protuberance 234 on an actuation member 202 to allow fluid pressure uphole of actuation member 202 to force actuation member 202 comprising collet sleeve 232 and plug member 250 downhole thereby likewise forcing sliding sleeve member 203 downhole thereby uncovering port 220. Chamfered edges 221 on groove 220 and continued fluid pressure exerted on actuation member 202 allow collet sleeve 232, and in particular collet fingers 240 thereon, to be radially inwardly compressed thereby causing protuberance 234 thereon to be likewise radially inwardly compressed, thereby freeing protuberances 234 from mating engagement with groove 220 and allowing continued downhole movement of actuation member 202 to actuate similar downhole slidable sleeve members having grooves 220 of similar or lesser widths W1.

In the embodiment of the system 200 shown in FIGS. 2A-2D, a second series/group of (second) ports 206', 206" are located downhole from said first ports 206, each of second ports 206', 206" having respective second sliding sleeve members 204, 205. Each of such sliding sleeve members 204, 205 have a circumferential groove 220 of width W2, wherein W2>W1.

Operation of Preferred Embodiment Shown in FIGS. 2A-2D and FIG. 3A-FIG. 8

The manner of operation of the system 200 for uncovering two separate groups of ports, namely first ports 206, and second group of (second) ports 206', 206" as shown in FIGS. 2A-2D and FIG. 3A-FIG. 8, is described below, and is in effect a duplication of the system shown in FIGS. 1A-1D described above, but with uphole sliding members 203 covering the group of first ports 206, such sliding members 203 (of the type shown in FIG. 3A) having grooves 220 thereon of a lesser width W1 than the circumferential grooves 220 of width W2 on associated sliding sleeve members 204, 205 of the type shown in FIG. 3B covering respective (second) ports 206', 206".

Specifically, as regards the operation of the system 200 for uncovering two separate groups of ports, a first actuation member 220 having thereon a protuberance 234 of width W2 is firstly inserted into bore 210, and propelled downhole by fluid pressure applied to bore 210. First actuation member 220, having a collet sleeve 232 and protuberances 234 thereon of width W2 does not engage circumferential groove 220 on (first) (uphole) sliding sleeve member(s) 203 covering first port 206 due to width W2 of protuberance 234 on first actuation member 220 being greater than width W1 of groove(s) 220 in first sliding sleeve member(s) 203. First actuation member 220 continues to travel further downhole in tubing liner 200.

First actuation member 202 when travelling further downhole then encounters sliding sleeve member 204 covering second port 206' (of the second group of second ports 206', 206"), and protuberance 234 matingly engages groove 220 therein, since width W2 of protuberance 234 on first actuation member is equal to (or somewhat less than) width W2 of groove 220 on collet sleeve 232. Fluid pressure on the uphole side of actuating member 202 causes further downhole movement thereof, causing sliding sleeve 204 to move downhole and thus uncover/open associated port 206'. A snap ring 270 may further engage the sliding sleeve 204 when in such open position, in order to retain sliding sleeve 204 in such position uncovering associated port 206'.

Due to chamfering (i.e. provision of chamfered shoulders 221) in groove 220, collet sleeve 232 (and in particular collet fingers 240 and protuberances 234 thereon) are radially inwardly compressed when downhole force is continued to be applied to actuation member 202, causing disengagement of protuberances 234 from groove 220. Such allows first actuation member 202 to continue to further downhole to actuate/open additional ports in said group of second ports 206', 206".

FIGS. 2C & 2D, along with FIGS. 4-7 showing an enlargement of the operation of the most-downhole sleeve 205 when actuated on by the first actuation member 202, and depict the system's operation in actuating the most-downhole sleeve 205 and uncovering the associated most-downhole (second) port 206".

Figure 7:
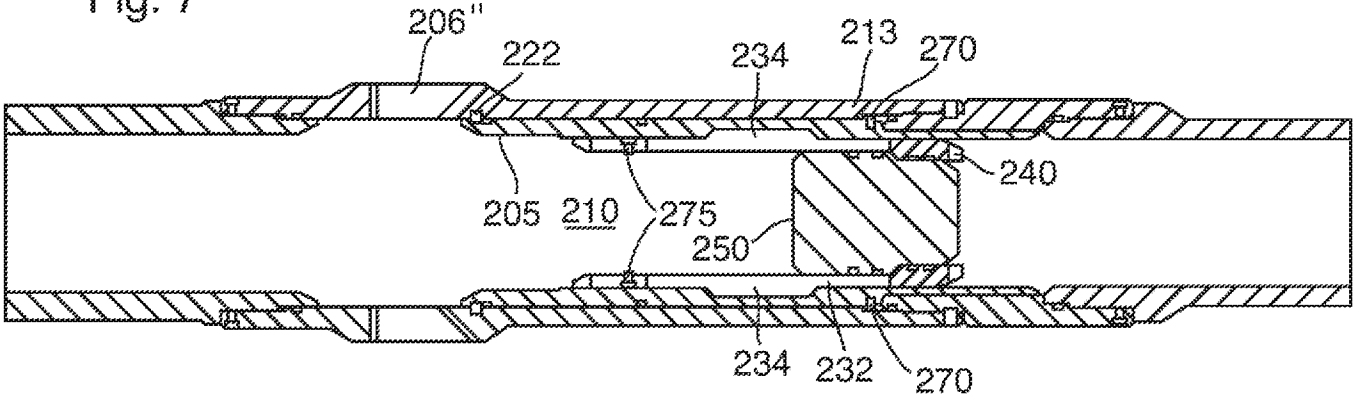
Figure 8:
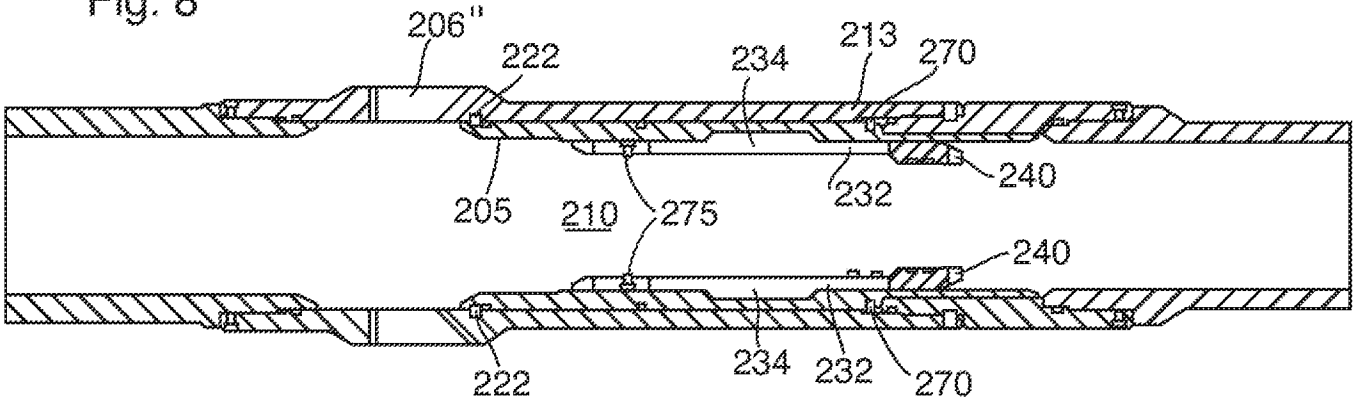

Upon protuberances 234 of width W2 on actuating member 202 encountering circumferential groove 220 on the most-downhole sliding sleeve 205 associated with downhole port 206", protuberance(s) 234 matingly engage groove 220 thereon. However, as the shear force necessary to shear the shear screws 222 securing sliding sleeve member 205 to associated pipe member 213 is greater than the force necessary to shear the shear pins 275 securing plug member 250 to uphole end of collet sleeve 232, continued fluid pressure acting on actuation member 202 therefore causes shear pins 275 to shear thereby allowing plug member 250 to slidably move to a second position within collet sleeve 232, namely to the downhole end of collet sleeve 232 as shown in FIG. 6, where shoulder members 255 on collet sleeve 232 arrest further movement downhole of plug member 250. Plug member 250 when is such second position prevents collet fingers 240 and associated protuberances 234 thereon from being inwardly radially compressed and thereby prevents protuberances 234 from becoming disengaged with circumferential groove 220 (ref. FIG. 6). Further fluid pressure applied to bore 210 uphole of first actuation member 202 then causes further downhole movement of plug member 202 thereby causing sliding sleeve 205 to move downhole and thus uncover/open associated port 206". A snap ring 270 may further be provided to engage sliding sleeve 205 when in such open position, to thereby retain sliding sleeve 204 in such position uncovering associated port 206", as shown in FIG. 7. Thereafter, fluid can be injected into the formation via open ports 206', 206", to allow fracking of the formation in the region of ports 206', 206".

Where a dissolvable plug member 250 has been used, action of fluid remaining in bore 210 dissolves plug member 250 leaving pipe members 212. 213 in a configuration to allow ingress of hydrocarbons from the formation via opened ports 206, 206', and 206" into the tubing liner for subsequent production to surface.

Alternatively, plug member 250 if not dissolvable may be reamed out by insertion of a reaming member (not shown) within liner 200 to thereby remove actuation member 202 and associated plug member 250 from within tubing liner 200 to prevent obstruction of fluids within liner 200.

In order to actuate/open additional uphole (first) port(s) 206 in a similar manner, in such further refinement another (second) actuating member 202 is employed, also having protuberance profiles 234 thereon. Second actuating member 202 differs only from the first actuating member 202 in that the second actuating member 202 has protuberances profiles 234 thereon of width W1, where W1 is less than the width W2 of protuberances 234 on first actuating member 202. The operation of second actuation member 202 on uphole sliding sleeve member(s) 203 to thereby actuate/uncover uphole (first) port(s) 206 is identical to the manner described above for utilizing first actuating member 202 in actuating downhole sliding sleeve members 204, 205 to open second ports 206', 206". Again, if desired, a snap ring 270 may further be provided to engage sliding sleeve 203 when in such open position, to thereby retain sliding sleeve 203 in such position uncovering associated port 206.

Again, if desired, burst ports may be provided over each of ports 206, 206', and 206". Likewise in such further embodiment utilizing groups of ports, burst plates 300 covering each of said ports in a plurality of groups of ports are expressly configured to rupture and allow fluid communication from said bore 210 only upon a fluid pressure in said bore exceeding:

(i) the fluid pressure necessary to cause plug member 250 in each of said first and second actuation member 202 and said associated collet sleeve 232 to shear the shear screws 222; and (ii) the fluid pressure necessary to cause plug member 250 in each of said first and second actuation members 202 to shear the shear pins affixing plug member 250 to the uphole side of collet sleeve 232 to shear and allow plug member 250 to move to said second position in each collet sleeve 232 when actuating/opening the most downhole sleeve in a group of ports.

The further embodiment of the invention and its method, will now be described with reference to FIGS. 9-17 which illustrate various aspects thereof.

Figure 9:
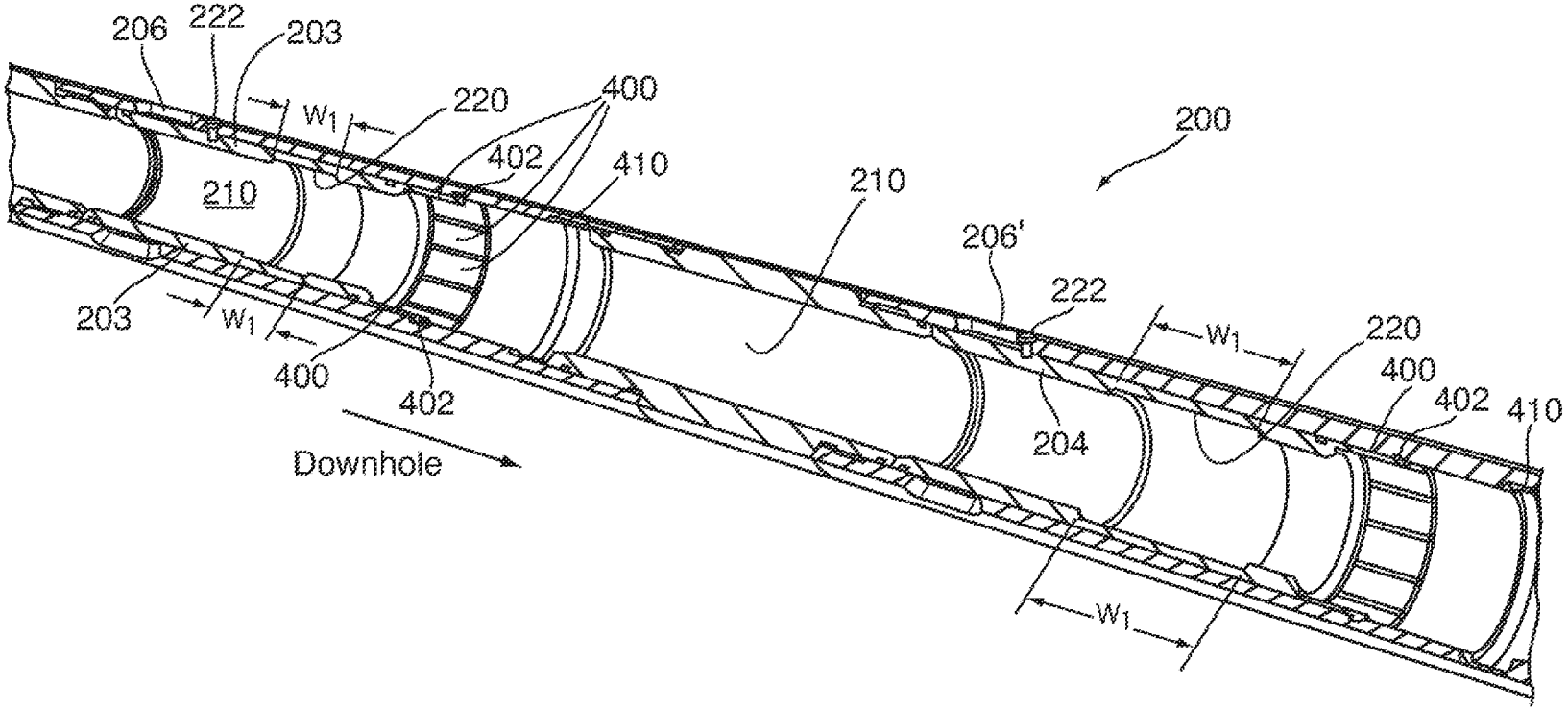
FIG. 9 is s perspective sectional view of a modified system, using modified sleeves adapted to receive a dart having a dissolvable ball therein, and which sleeves each have a uniquely sized or proportioned annular recess therein adapted to matingly engage only a unique dart having a mating unique profile.

FIG. 9 shows a portion of a tubing liner 200 of the present invention when installed in a wellbore, and prior to injection in tubing liner 200 of an actuation member 202. Sliding sleeve members 203, 204, are shown in their initial (closed) position covering respective ports 206, 206' in tubing liner 200. In the embodiment shown in FIG. 9, each of sliding sleeve members 203, 204 at a lowermost downhole end thereof possess radially-outwardly biased and extending tab members 400, upwardly protruding ends 402 thereof being configured to engage an aperture 410 in said tubing liner 200 when a respective of said sliding sleeve members 203, 204 is moved to uncover an associated port 206, 206', which ends 402 of tab members 400 when engaged in said aperture 410 prevent respective of said sliding sleeve members 203, 204 from moving uphole to thereby close an associated port 206, 206'.

Figure 10:
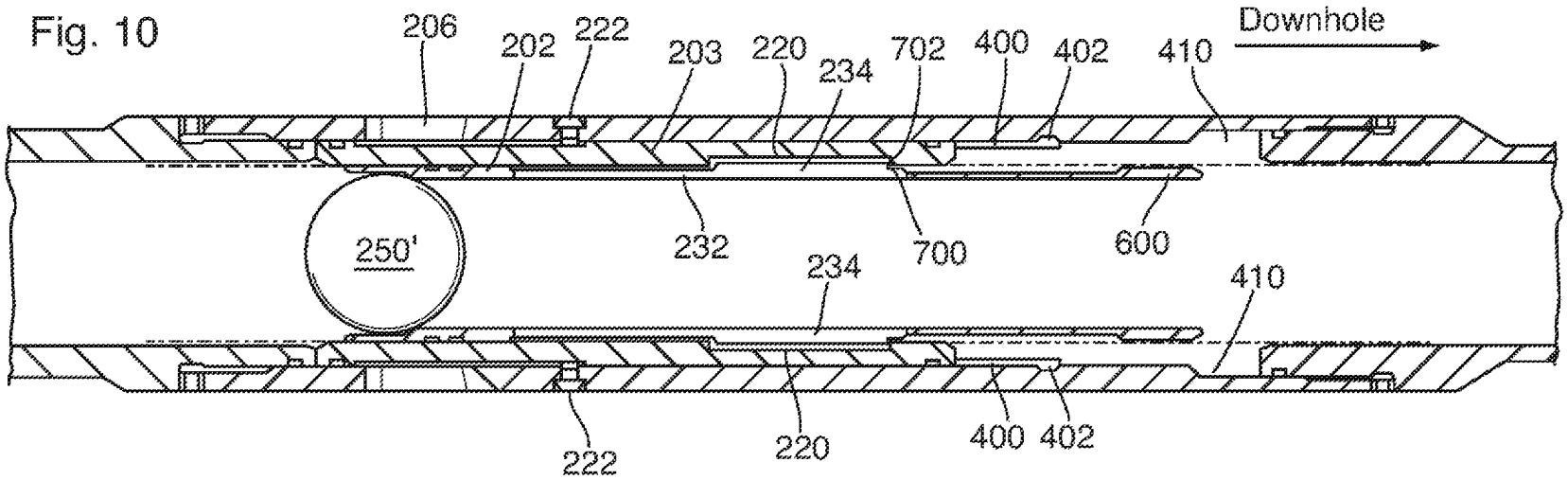
FIG. 10 is a cross-section through a sleeve and dart, when the unique resiliently-biased profile of a particular dart has matingly engaged a correspondingly uniquely dimensioned annular recess of a particular sliding sleeve.
Figure 11:
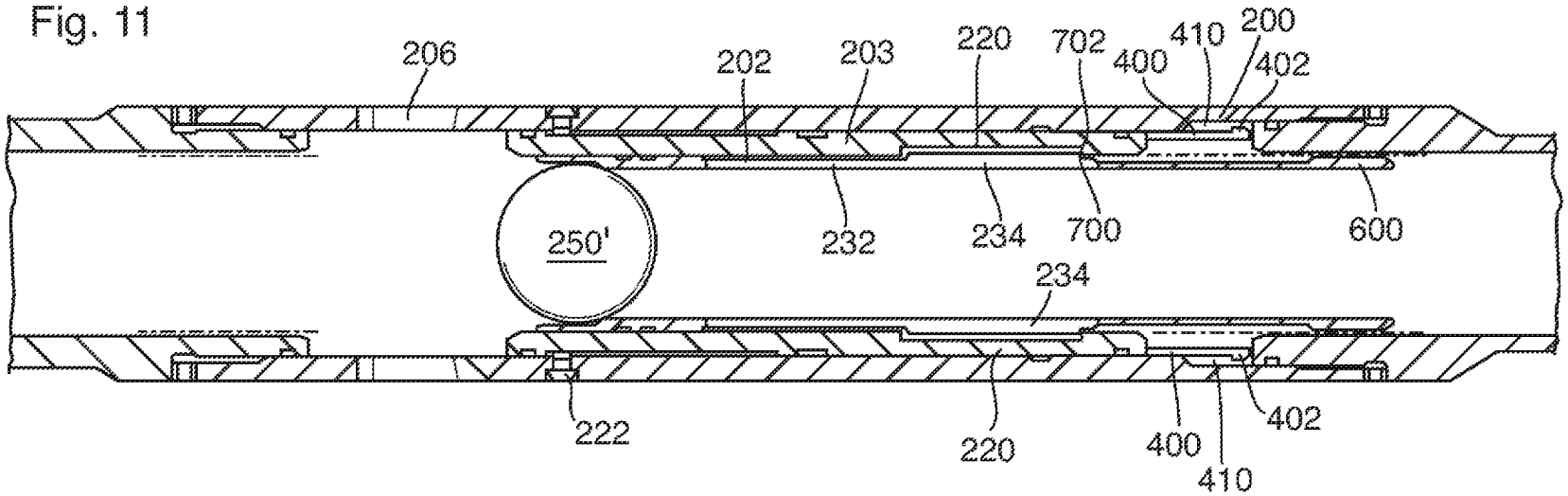
FIG. 11 is a similar cross-section through the same sleeve and dart, taken at a later point in time, namely when fluid pressure exerted uphole has forced shearing of the shear screws originally retaining the sliding sleeve covering the port/slots within the pipe mandrel, and moved the sleeve so downhole so as to uncover the port and allow engagement of collet fingers on the dart with a recess in the pipe to retain the sleeve in such position uncovering the port.

FIGS. 10 and 11 show a sequence of operation of one actuation member 202, when a plug member 250 such as a spherical ball 250' and actuation member 202 are forced downhole via fluid pressure injected at surface into tubing liner 200.

Specifically, FIG. 10 shows the initial engagement of the radially outwardly-biased protuberance profile 234 of width W1 on actuation member 202, with interior annular groove 220 in sliding sleeve member 203 of corresponding width W1.

FIG. 11 shows the subsequent position of sliding sleeve member 203, after pressurized fluid has been injected uphole of actuation member 202, and ball member 250' has forced sliding sleeve member 203 and tabs 400 downhole so as to open ports 206 and simultaneously cause ends 402 on tab members 400 to engage aperture 410 in tubular liner 200, thereby thereafter preventing slidable sleeve member 203 from moving back uphole.

Importantly, FIGS. 10 and 11 show an abrupt edge 700, 702 on respectively a downhole side of each of inner groove 220 and protruding profile/protuberance 234, which abrupt edges 700, 702 together prevent further downhole movement of actuating member 202 within tubing liner 200. For actuation members 202 having such abrupt edge 700, actuation member 202 can only be used for engaging and moving a single sliding sleeve member 203, which may be desired for some fracking operations looking to only open a single localized port 206 in said tubing liner 200 for a particular fracking operation.

However, if movement of other sliding sleeve members (e.g. such as additional downhole sliding sleeve member 204) is desired, another actuation member 202' need be employed. In such an embodiment it is useful if the actuation member 202 comprising collet sleeve 232 and protuberance/profile 234 is made dissolvable, namely of a dissolvable material which relatively rapidly dissolves in a fluid such as a highly basic or acidic fluid which may be injected downhole in said tubing liner 200 to thereby remove actuation member 202 from tubing liner 200.

Figure 12:
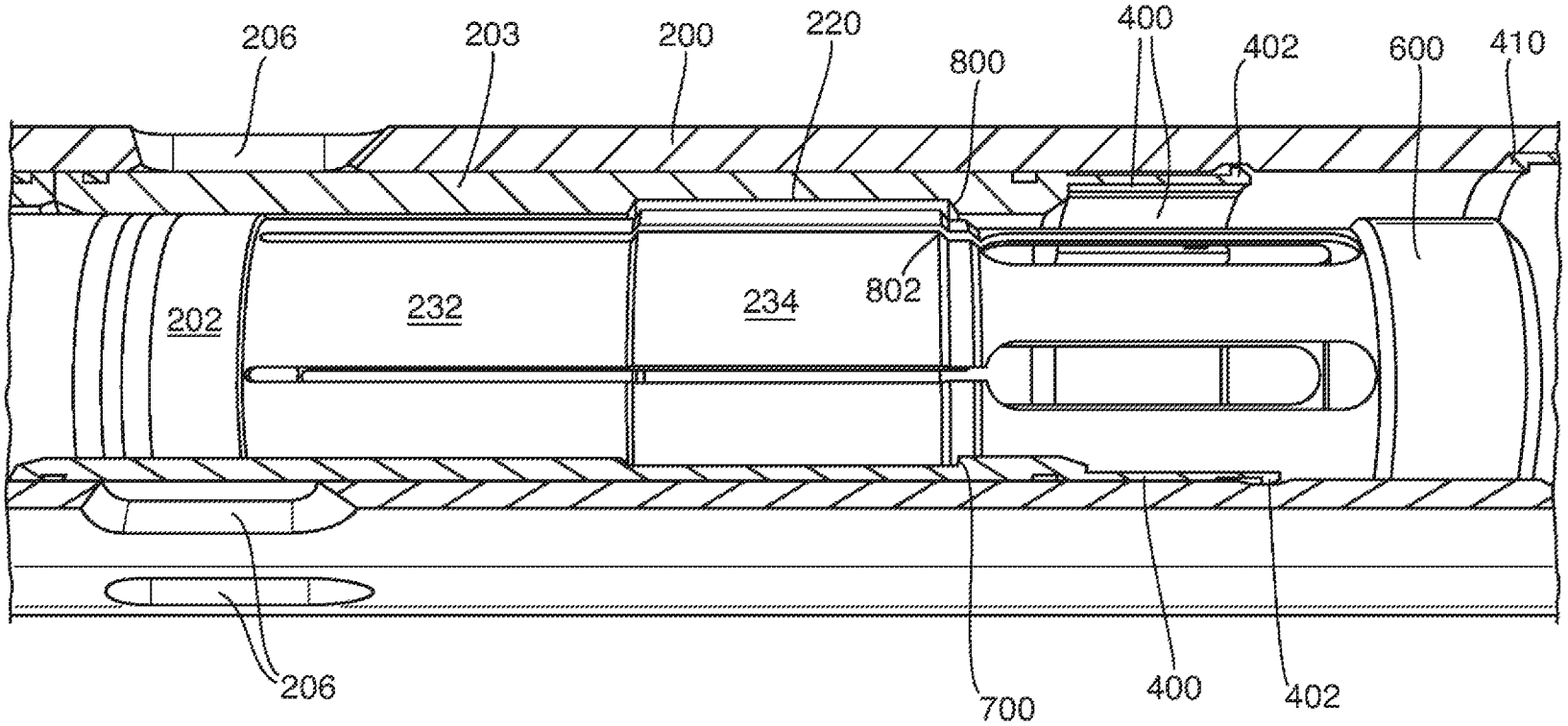
FIG. 12 is 3-dimensional enlarged view of the components shown in FIG. 10.
Figure 13:
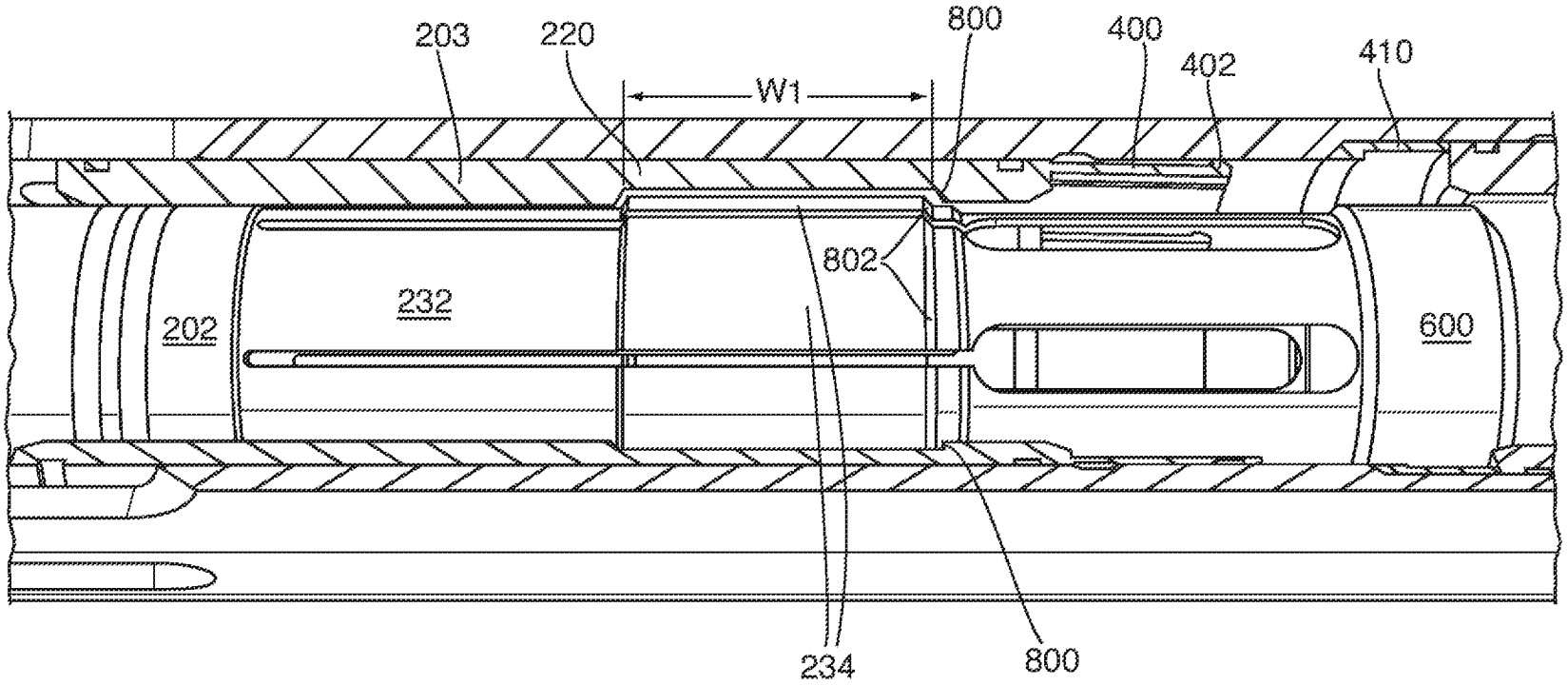
FIG. 13 is a 3-dimensional enlarged view of the components shown in FIG. 10, with fluid pressure being applied uphole to cause the dart with engaged sleeve to being to be moved downhole in order to commence opening the ports in the pipe mandrel.
Figure 14:
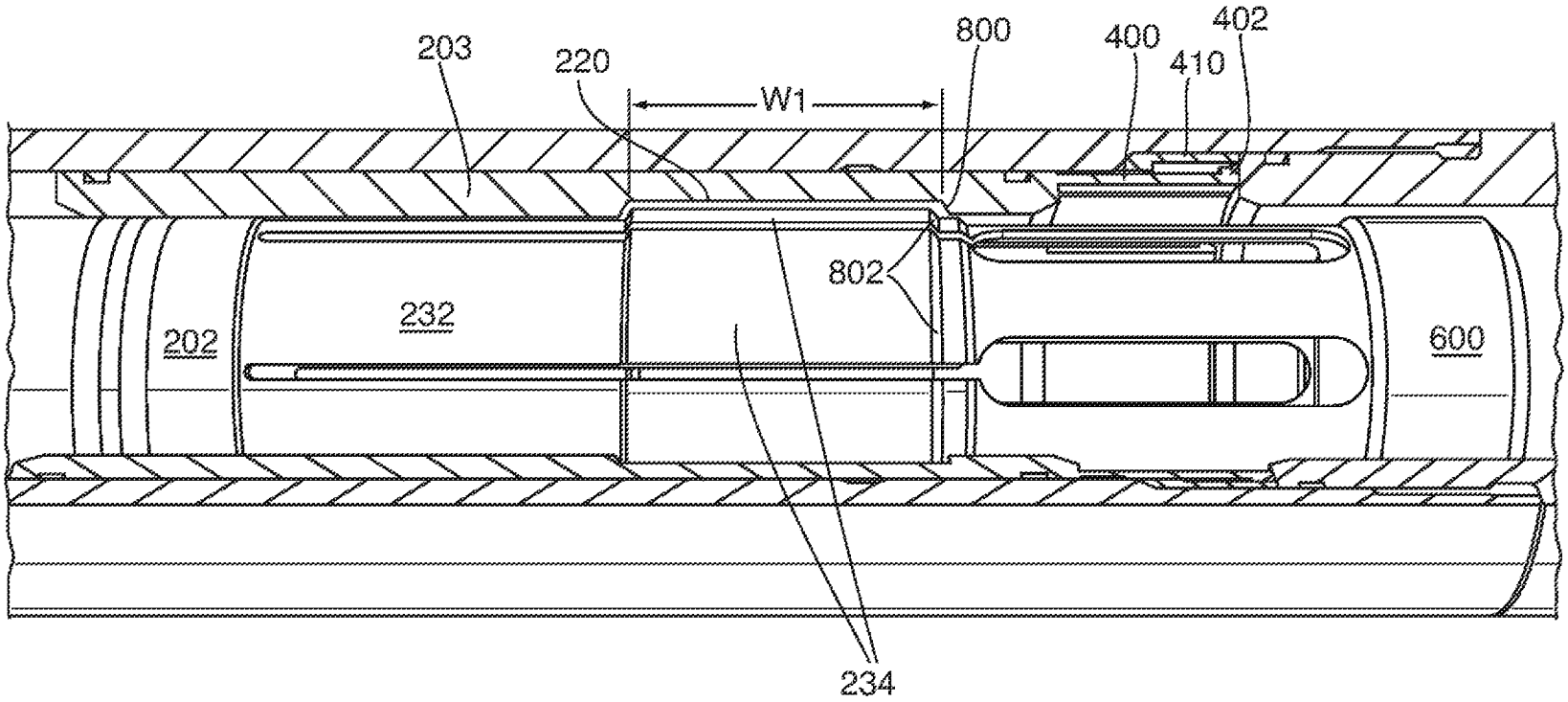
FIG. 14 is a 3-dimensional enlarged view of the components shown in FIG. 10, with fluid pressure having been being applied uphole for a further period of time so that the dart with engaged sleeve has been moved further downhole in order to completely open the ports in the pipe mandrel.

FIGS. 12, 13, and 14 show a three dimensional partial cut-away rendition of the two-dimensional illustrations shown in FIGS. 10 & 11, showing in FIG. 12 the protruding profile 234 of width W1 on actuation member 202 initially engaging inner circumferential groove 220 of width W1 in sliding sleeve member 203. FIGS. 12-14 illustrate consecutive steps (i)-(iii) of the method set out above in the Summary of the Invention.

Importantly, FIGS. 12, 13, and 14 however show a variation of the protuberance profile 234 and interior groove 220, wherein interior groove 220 on a downhole side edge thereof and/or said protruding profile 234 on a downhole side edge thereof are each provided with a chamfer 800, 802, respectively. Such a configuration advantageously permits, after actuation member 202 has matingly engaged a respective of said interior circumferential grooves 220 on an associated slidable sleeve member 203 and moved said slidable sleeve member 203 downhole to open an associated port 206, said resiliently-outwardly-biased profile 234 on actuation member 202 to be released from said mating engagement therein upon further fluid pressure being applied uphole to said plug member 250'. In such manner actuation member 202 may advantageously then continue downhole, along tubular member 200 as shown in FIG. 9, to then actuate additional downhole sliding sleeve member 204 having similarly-dimensioned inner circumferential groove 220 of width W1, and thereby open additional downhole port 206' and potentially other downhole ports in a group desired to be opened by single actuation member 202 (ref. FIG. 9).

FIG. 12 shows actuation member 202 having a protruding profile 234 of width W1 matingly engaging circumferential groove 220 of width W1.

FIG. 13 shows the actuation member 202 having partially moved sliding sleeve member 203 to partially uncover ports 206 in tubing liner 200.

FIG. 14 shows the actuation member 202 having completely moved sliding sleeve member 204 to completely uncover ports 206' in tubing liner 200, so that tab members 400, and in particular protruding ends 402 thereof, have then engaged aperture 410 in tubular liner 200, thereby preventing sliding sleeve member from thereafter moving uphole to again cover ports 206'. Additional fluid pressure exerted on ball member 250' and actuation member 202 causes chamfer surfaces 800 and 802 on circumferential groove 220 and profile 234 respectively to abut and thereby allow actuation member to thereafter pass downhole to actuate similar sleeves having groove 220 therein, until a circumferential groove 220 in a sliding sleeve member is encountered not having a chamfer 800 thereon, at which point further downhole movement of actuation member 202 may be stopped. This will be the case if actuation member 202 is not provided with a chamfer 800 and instead provided with an abrupt edge 700 as shown in FIGS. 10 & 11, which when encountering a circumferential groove 220 having an abrupt edge 700, will be prevented from disengaging the respective sliding sleeve member and forced to remain matingly engaged to such sliding sleeve member.

Figure 15:
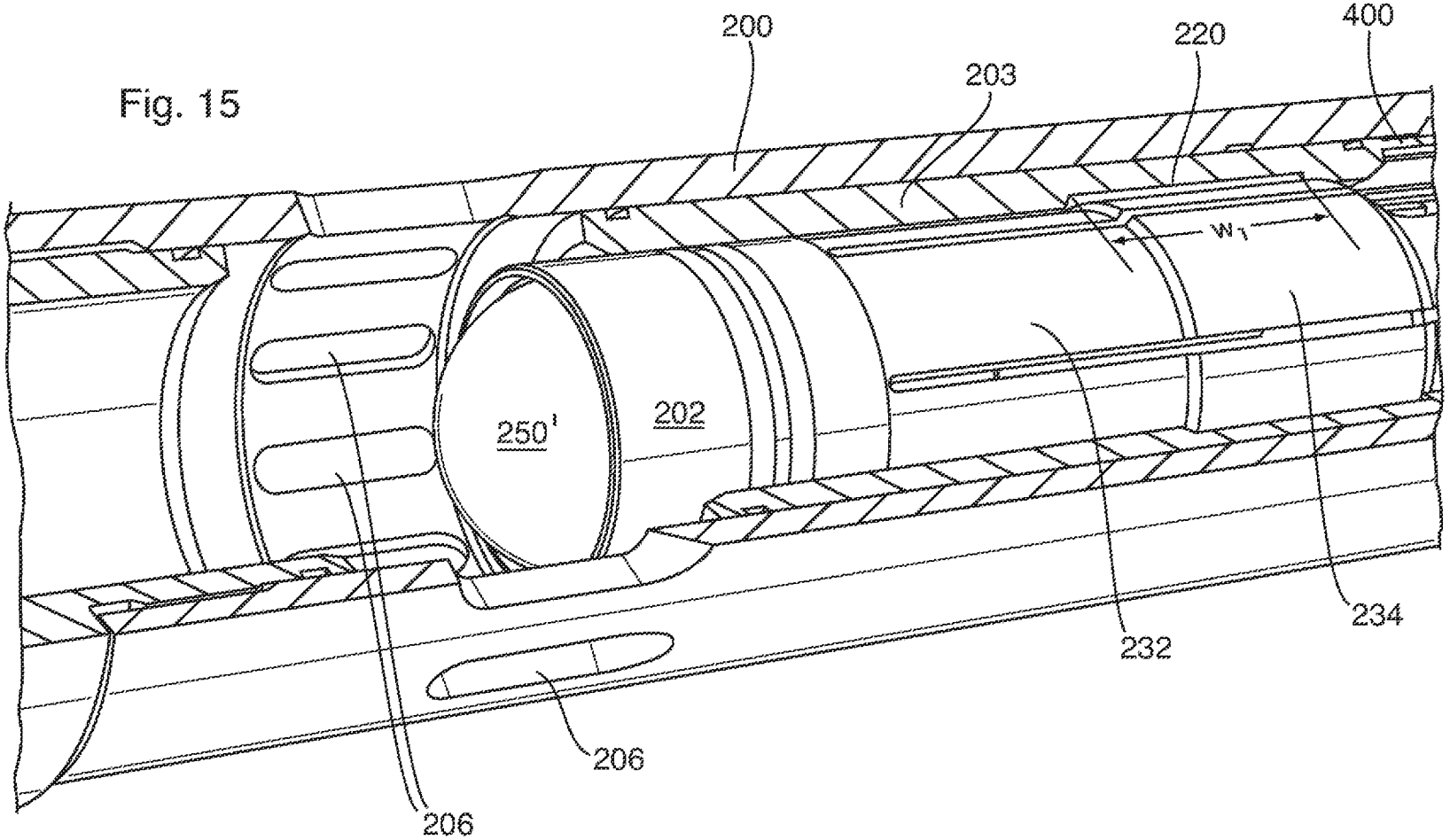
FIG. 15 is a another view of the sliding sleeve and dart, with ball, showing the position after the ports have been opened.

FIG. 15 shows the position of actuation member 202 and ball member 250' thereof, after having opened ports 206.

Figure 16:
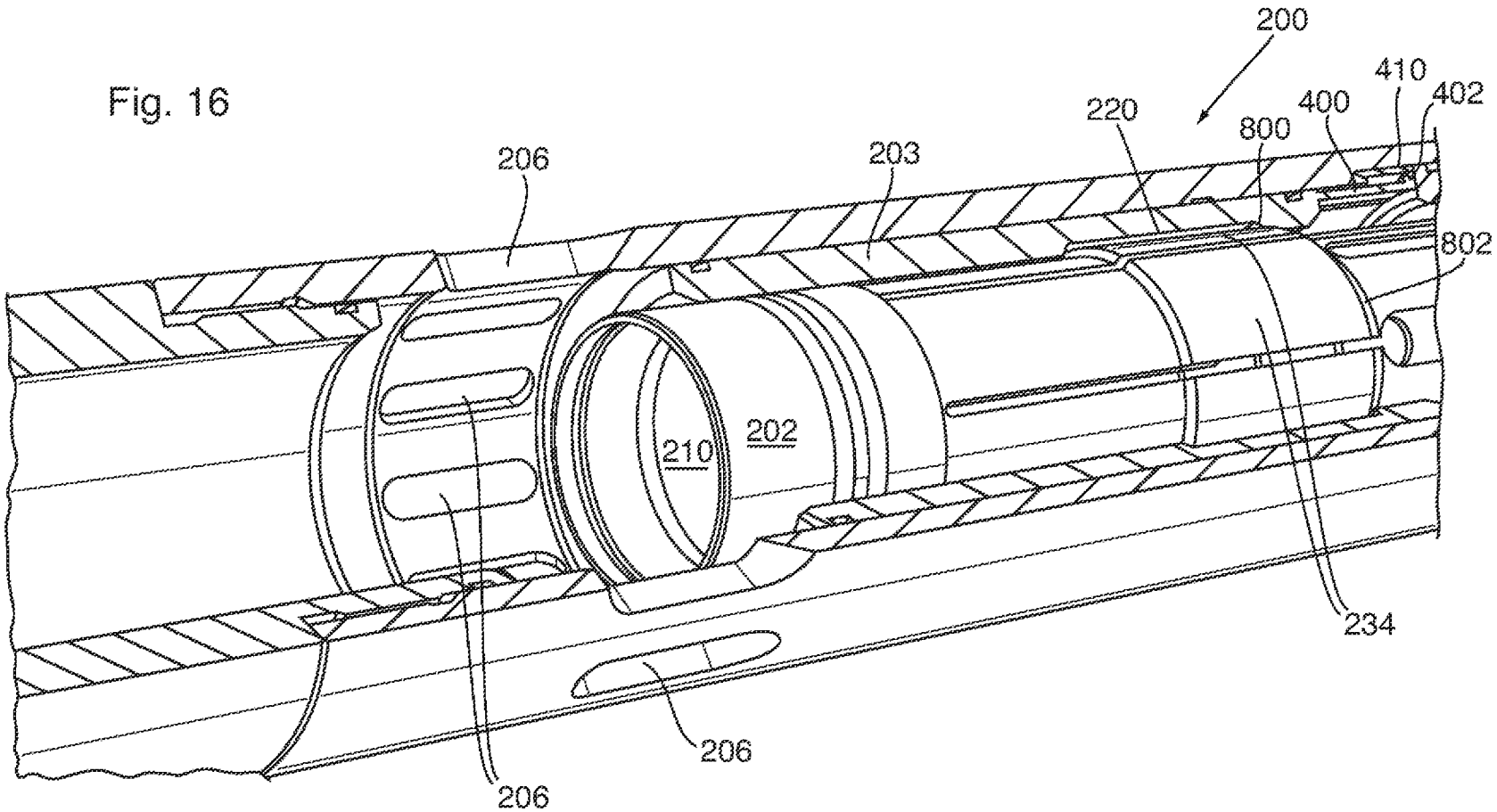
FIG. 16 is a similar view of the sliding sleeve and dart, after a further period of time when the ball has dissolved thus opening the pipe for flow.

FIG. 16 shows a subsequent step in the method, wherein the plug member 250 (ball 250') has dissolved.

The above process may be repeated for similar of downhole sliding sleeve members 203 having a consistent width W1, by employing chamfers on said downhole edge of each of said circumferential groove 220 and protuberance profile 234, to allow actuation member 202 to disengage from a respective sliding sleeve member after opening such sleeve member, for subsequent travel downhole to actuate other similar sleeve members with identically configured/sized circumferential grooves 220.

Figure 17:
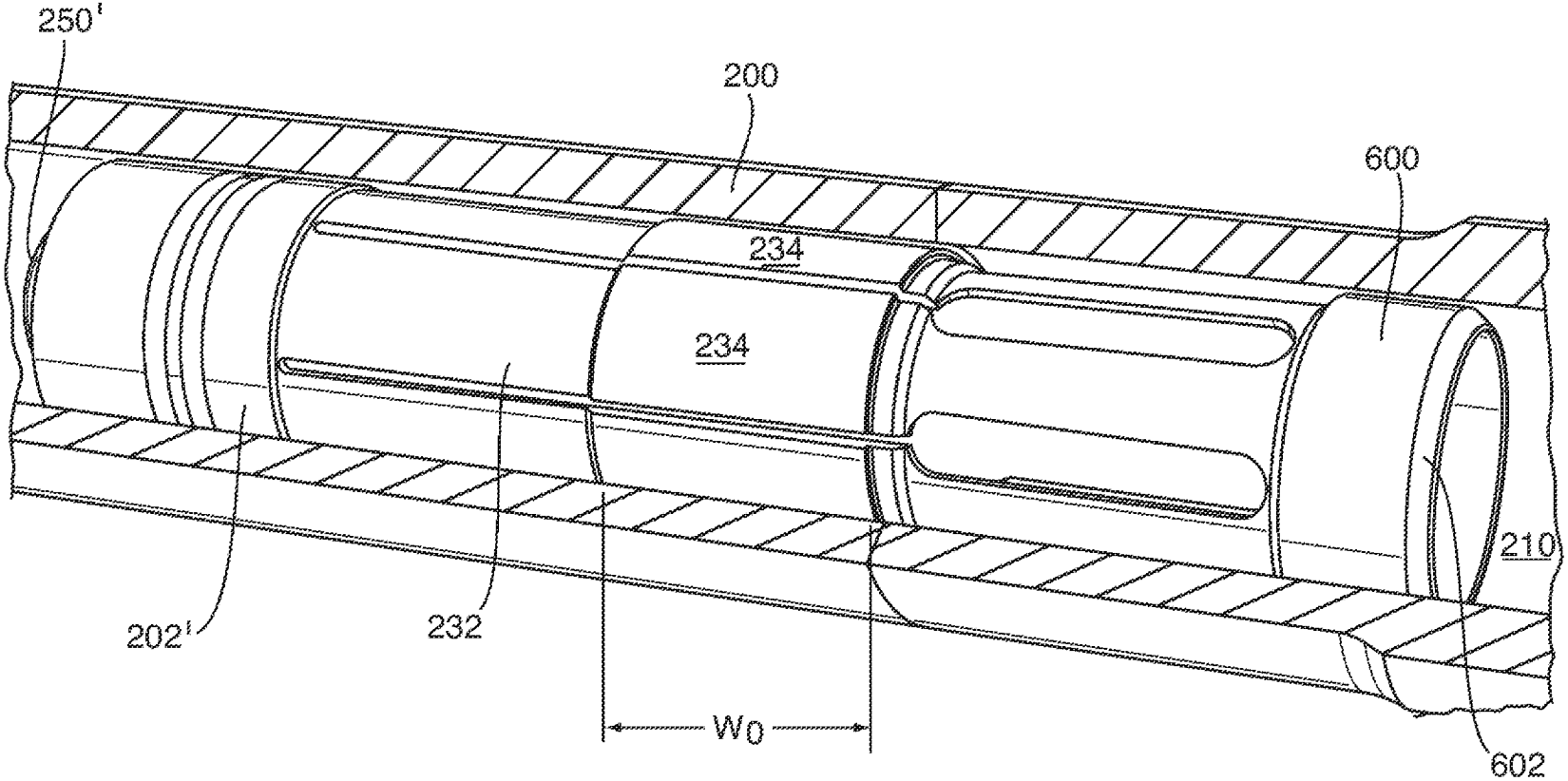
FIG. 17 is a view of the dart member, while being run downhole in the pipe.

For other groups of uphole sliding sleeve members, where circumferential grooves 220 therein are of a lesser width than $W_1$, an actuation member such as the actuation member 202' shown in FIG. 17 having a protuberance profile 234 of corresponding lesser width $W_0$, may be used to consecutively then open sliding sleeve members in such group.

As may be seen from FIG. 17, actuation member 202' may be provided with an annular ring 600 of a diameter substantially equal to the diameter of the sliding sleeve members, to assist actuation member 202' in moving downhole in the tubular liner without becoming otherwise "cocked" in said liner 200. A bevel 602 on ring 600 may further be provided to further assist in this function.

The above description of some embodiments of the system and method of the present invention is provided to enable any person skilled in the art to make or use the present invention.

For a complete definition of the invention and its intended scope, reference is to be made to the summary of the invention and the appended claims read together with and considered with the disclosure and drawings herein.

Reference to an element in the singular, such as by use of the article "a" or "an" is not intended to mean "one and only one" unless specifically so stated, but rather "one or more". In addition, where reference to "fluid" is made, such term is considered meaning all liquids and gases having fluid properties.

Reference made to "lowermost", "lower, "uppermost", and "upper", and all other adjectives of relativistic reference mean in relation to the position of a component when placed in a vertical wellbore.

The invention claimed is:

1. A system for successively uncovering a plurality of contiguous spaced-apart ports along a wellbore, comprising:

(i) a tubular liner having a bore, further comprising:

(a) a plurality of said spaced-apart ports or groups of ports longitudinally and contiguously spaced along said tubular liner;

(b) a corresponding plurality of cylindrical sliding sleeve members, each longitudinally slidable within said bore, each configured in an initial closed position to overlap a corresponding of said ports, and when slidably moved to an open position to uncover said corresponding port, each of said sliding sleeve members save and except for a most downhole of said sliding sleeve members having therein an interior circumferential groove which comprises a chamfer on a downhole side thereof, the most-downhole sliding sleeve member having therein an interior circumferential groove which comprises an abrupt edge or chamfer on a downhole side thereof;

(c) a shear member, initially securing said sliding sleeve members to said tubular member in said initial closed position, and sheareable when a force exceeds a given amount is applied to a respective of said sliding sleeve members;

(ii) an actuation member positionable within said bore, comprising:

(a) a cylindrical hollow collet sleeve, having a radially-outwardly biased and protruding protuberance, said protuberance configured to successively matingly engage each of said respective interior circumferential grooves on said sliding sleeve members, wherein said protuberance is of a substantially equal or lesser width than a width of said circumferential grooves on each of said sliding sleeve members and wherein said protuberance is adapted to disengageably engage a downhole side edge of said circumferential grooves on said sliding sleeve members save and except for the most-downhole sliding sleeve member and for non-disengageably engaging the circumferential groove on the most-downhole sliding sleeve member, and wherein said protuberance upon being inwardly compressed allows said collet sleeve and protuberance thereon to become disengaged from mating engagement in said circumferential groove;

(b) a plug member, initially affixed via a shear pin or pins to said collet sleeve and situated within said collet sleeve and when in a first position situated at an uphole end thereof, which at least for a limited time together with said collet sleeve substantially obstructs passage of fluid within said bore when said collet sleeve and plug member are together situated in said bore;

wherein fluid pressure applied to an uphole end of said actuation member causes said actuation member to move downhole and successively engage said circumferential groove in each of said sliding sleeve members save and except for the most-downhole sliding sleeve member, and move said respective sliding sleeve member downhole so as to thereby uncover each of said plurality of ports, and move downhole to a next of said sliding sleeve members; and wherein, when said actuation member moves into the most-downhole sliding sleeve member under the fluid pressure applied to the uphole end thereof and engages said circumferential groove in the most-downhole sliding sleeve member and thereafter moves the most-downhole sliding sleeve member to the open position, said shear pin or pins each shear, and said plug member under the fluid pressure applied to the uphole end thereof, moves downhole in said actuation member to a second position therein substantially radially beneath said protoberance, thereby preventing said protuberance from disengagement with said circumferential groove in said most-downhole sliding sleeve.

2. The system for successively uncovering said plurality of contiguous spaced-apart ports as claimed in claim 1, further having burst plates covering each of said ports, said burst plates adapted to rupture and allow fluid communication from said bore to said port only upon a fluid pressure in said bore exceeding:

(i) the fluid pressure necessary to cause said plug member and collet sleeve to shear said shear member; and (ii) the fluid pressure necessary to cause said plug member to shear said shear pin or shear pins and move to said plug member to said second position.

3. The system for successively uncovering said plurality of contiguous spaced-apart ports as claimed in claim 1, wherein said plug member is dissolvable, and after moving to said second position and after a period of time being exposed to fluid within said bore, becomes dissolved.

4. The system for successively uncovering said plurality of contiguous spaced-apart ports as claimed in claim 1, further comprising:

(i) a snap-ring member, associated with each of said plurality of sliding sleeve members, which locks each sliding sleeve member in said open position upon said sliding sleeve member being moved to said open position.

5. The system for successively uncovering said plurality of contiguous spaced-apart ports as claimed in claim 1, wherein said plug member upon movement to said second position prevents said protuberance from being radially inwardly compressed and said actuation member is thereby prevented from further movement downhole.

6. A system for successively uncovering at a first and more downhole second group of contiguous spaced-apart ports along a wellbore, comprising:

(i) a tubular liner having a bore, further comprising:

(a) a first group of ports, comprising a plurality of first spaced-apart ports longitudinally and contiguously spaced along said tubular liner;

(b) a corresponding plurality of first cylindrical sliding sleeve members, each longitudinally slidable within said bore, each configured in an initial closed position to overlap a corresponding of said first ports in said first group of ports, and when slidably moved to an open position to not overlap said first port, each of said first sliding sleeve members having an interior circumferential groove therein of a first width, wherein the circumferential groove of each of said first sliding sleeve members save and except for the circumferential groove in a most-downhole of said first sliding sleeve members comprises a chamfer on a downhole side thereof, and wherein the circumferential groove of the most-downhole first sliding sleeve member comprises an abrupt edge on a downhole side thereof;

(c) a second group of ports comprising a plurality of second spaced-apart ports longitudinally and contiguously spaced along said tubular liner, situated in said tubular liner downhole from said first group of ports;

(d) a corresponding plurality of second cylindrical sliding sleeve members, located in said tubular member more downhole than said first sliding sleeve members, each second cylindrical sliding sleeve member longitudinally slidable within said tubular liner, each configured in an initial closed position to overlap a corresponding of said second ports in said second group of ports and when slidably moved to an open position to not overlap said corresponding second port, each of said second sliding sleeve members having an interior circumferential groove therein of a second width, wherein said second width is greater than said first width wherein the groove of each of said second sliding sleeve members save and except for a most-downhole of said second sliding sleeve members comprises a chamfer on a downhole side thereof;

(e) shear members, respectively securing said first and second sliding sleeve members to said tubular liner in said initial closed position, and sheareable when a force is applied to a respective of said first and second sliding sleeve members;

(ii) a first actuation member positionable within said bore, comprising:

(a) a cylindrical hollow collet sleeve, having a plurality of elongate longitudinally extending finger members thereon, said finger members having thereon a radially-outwardly biased and protruding protuberance, said protuberance configured to successively matingly engage said respective interior circumferential groove on each of said second sliding sleeve members, wherein said protuberance is of a width substantially equal to said second width but greater than said first width, for causing when engaged with a respective cylindrical groove on a respective second sliding sleeve member such second sliding sleeve members to move downhole and the protuberance thereon thereafter adapted to disengage each of said second sliding sleeve members save and except for the most-downhole second sliding sleeve members, such that said protuberance upon fluid pressure being applied to an uphole side of said first actuation member is inwardly compressed to allow said collet sleeve and protuberance thereon to become disengaged from mating engagement in said circumferential groove in said second sliding sleeve members;

(b) a plug member, situated within said collet sleeve and when in a first position situated at an uphole end of said collet sleeve, which at least for a limited time together with said collet sleeve substantially obstructs passage of fluid within said bore when said collet sleeve and plug member are together situated in said bore;

wherein fluid pressure applied to an uphole end of said first actuation member causes said first actuation member to move downhole and cause said collet sleeve thereof to successively engage said second circumferential groove in each of said second sliding sleeve members, and move each of said respective second sliding sleeve members downhole so as to thereby uncover each of said plurality of second ports;

said system further comprising:

(iii) a second actuation member positionable within said bore, comprising:

(a) a cylindrical hollow collet sleeve, having a plurality of elongate longitudinally extending finger members thereon, said finger members having thereon a radially-outwardly protruding protuberance, said protuberance configured to successively matingly engage said respective interior circumferential groove on each of said first sliding sleeve members, wherein said protuberance is of a width substantially equal to or less than said first width, and less than said second width, wherein said protuberance upon fluid pressure being applied to an uphole side of said second actuation member is inwardly compressed to allow said collet sleeve and protuberance thereon to become disengaged from mating engagement in said circumferential groove in each of said first sliding sleeve members save and except for a most downhole of said first sliding sleeve members;

(b) a plug member, situated within said collet sleeve and when in a first position situated at an uphole end thereof and affixed to said collet sleeve via one or more shear pins, which plug member at least for a limited time together with said collet sleeve substantially obstructs passage of fluid within said bore when said collet sleeve and plug member are together situated in said bore;

wherein fluid pressure applied to an uphole end of said second actuation member causes said second actuation member to move downhole and said collet sleeve and the protuberance thereon to successively engage successive more downhole circumferential grooves in each of said first sliding sleeve members and move each of said first sliding sleeve members downhole so as to thereby uncover each of said plurality of first ports, and thereafter due to said protuberance acting upon said chamfer on said downhole edge of said circumferential groove, be disengaged therefrom to permit further downhole movement and upon reaching said most-downhole of said first sliding sleeve members, remain lockingly engaged to said most-downhole of said first sliding sleeve members by said abrupt edge on said downhole edge of said circumferential groove therein.

7. The system for successively uncovering said plurality of contiguous spaced-apart ports as claimed in claim 6, further having burst plates covering each of said ports, said burst plates adapted to rupture and allow fluid communication from said bore to said port only upon a fluid pressure in said bore exceeding:

(i) the fluid pressure necessary to cause said plug member in each of said first and second actuation member and said associated collet sleeve to shear said shear member; and (ii) the fluid pressure necessary to cause said plug member in each of said first and second actuation member to shear said shear pin and move to said plug member more downhole in said collet sleeve to a second position immediately radially overlying said protuberance.

8. The system as claimed in claim 7, wherein said plug member in said second actuation member, after opening a most-downhole first sliding sleeve member has been slid downhole to thereby uncover the respective port and said protuberance thereon engages said abrupt edge of said circumferential groove on said most-downhole first sliding sleeve member thereby preventing further downhole movement of said second actuation member, shears said shear pin therein or shear pins and moves downhole in said collet sleeve from said first position therein to a second position thereby preventing said protuberance from being inwardly compressed and thereby locking said second actuation member in said most-downhole of said first sliding sleeves.

9. The system as claimed in claim 8, wherein said plug member in said second actuation member is dissolvable in a fluid which may be injected downhole.

10. The system as claimed in claim 6, wherein said plug member in said second actuation member, after said most-downhole first sliding sleeve member has been slid downhole to thereby uncover the respective port and said protuberance thereon engages said abrupt edge of said circumferential groove on said most-downhole first sliding sleeve member thereby preventing further downhole movement of said second actuation member, shears said shear pin or shear pins therein and moves downhole in said collet sleeve from said first position therein to a second position immediately overlying said protuberance thereby preventing said protuberance from being inwardly compressed, thereby locking said second actuation member in said most-downhole of said first sliding sleeves.

11. The system as claimed in claim 7, wherein said plug member in said second actuation member is dissolvable in a fluid which may be injected downhole.

12. The system as claimed in claim 10, wherein said plug member in said second actuation member is dissolvable in a fluid which may be injected downhole.

13. The system as claimed in claim 6, wherein said plug member in said second actuation member is dissolvable in a fluid which may be injected downhole.

14. A system for successively uncovering at least two separate groups of contiguous spaced-apart ports along a pipe inserted in a wellbore, comprising:

(i) a tubular liner having a bore, further comprising:

(a) at least two groups of said spaced-apart ports longitudinally and contiguously spaced along said tubular liner;

(b) a corresponding plurality of cylindrical sliding sleeve members, each of said sleeve members associated with a respective of said plurality of spaced-apart ports, each sliding sleeve member longitudinally slidable within said bore and configured in an initial closed position to overlap a corresponding of said ports, and when slidably moved to an open position to uncover a corresponding of said ports, each of said sliding sleeve members having an interior circumferential groove, a width of said interior circumferential groove in said sliding sleeve members associated with a first group of contiguous spaced-apart ports being different than a width of said interior circumferential grooves in said sliding sleeve members associated with a second group of contiguous spaced-apart ports;

(c) a shear member, initially securing said sliding sleeve members in said initial closed position, and sheareable when a force is applied to a respective of said sliding sleeve members;

(ii) a first actuation member positioned within said bore, comprising:

(a) a cylindrical hollow collet sleeve, having a radially-outwardly biased and protruding profile, said profile configured to matingly engage said interior cylindrical grooves in each of said sliding sleeves associated with a first more uphole of said at least two groups of ports;

(b) a dissolvable plug member, dimensioned so as to be positionable and remain lodged within said collet sleeve of said first actuation member at an uphole end thereof, which at least for a limited time when not dissolved together with said collet sleeve substantially obstructs passage of a fluid within said bore when said collet sleeve and dissolvable plug member are together situated in said bore, and becomes dissolved after said fluid is injected down said wellbore;

wherein fluid pressure applied to an uphole end of said first actuation member causes said first actuation member to move downhole and engage said interior circumferential groove in said at least one sliding sleeve member associated with said first second group of ports, and not engage said interior circumferential grooves of a different width in remaining cylindrical sliding sleeve members associated with said first second group of ports, and move each sliding sleeve member associated with said second first group of ports downhole so as to thereby uncover said ports in said second first group of ports; and (iii) a second actuation member positioned within said bore, comprising:

(a) a cylindrical hollow collet sleeve, having a radially-outwardly biased and protruding profile, said protruding profile configured to matingly engage said interior cylindrical grooves in said sliding sleeves associated with a second of said at least two groups of ports;

(b) a dissolvable plug member, dimensioned so as to be positionable and remain lodged within said collet sleeve of said second actuation member at an uphole end thereof, which at least for a limited time when not dissolved together with said collet sleeve substantially obstructs passage of a fluid within said bore when said collet sleeve and dissolvable plug member are together situated in said bore, and becomes dissolved after said fluid is injected down said tubular liner;

wherein fluid pressure applied to an uphole end of said dissolvable plug member of said first actuation member upon a fluid being injected down said tubular liner, causes said first actuation member to move downhole and said protruding profile thereon to engage said interior circumferential groove in said at least one sliding sleeve members associated with said second group of ports, and move each sliding sleeve member associated with said second group of ports downhole so as to thereby uncover said ports in said second group of ports;

wherein the protruding profile of the second actuation members after engaging the respective sliding sleeve member of said first sliding sleeve members and causing the respective sliding sleeves to uncover the respective first ports, disengages from the circumferential groove of each of said first sliding sleeve members save and except for the most-downhole of said first sliding sleeve members where it remains lockingly engaged.

15. The system for successively uncovering at least two separate groups of contiguous spaced-apart ports along a wellbore as claimed in claim 14, wherein:

said interior circumferential grooves on a downhole side thereof being provided with a chamfer thereon so as to permit, after said resiliently radially-outwardly biased protruding profile on said first or second actuation member has matingly engaged a respective of said interior circumferential grooves on an associated sliding sleeve member and moved said sliding sleeve member to open an associated port, said resiliently-outwardly-biased profile on said first or second actuation member to be released from said mating engagement therein upon further fluid pressure being applied uphole to said plug member, to thereby allow said first or second actuation member to continue downhole to actuate additional downhole sliding sleeve members and open additional downhole ports.

16. The system for successively uncovering at least two separate groups of contiguous spaced-apart ports along a wellbore as claimed in claim 15, wherein:

each of said sliding sleeve members, at a lowermost end thereof, possess radially-outwardly biased and extending tab members which engage an aperture in said pipe when a respective of said sliding sleeve members is moved to uncover an associated port, which tab members when engaged in said aperture prevent respective of said sliding sleeve members from moving uphole to thereby close an associated port.

17. The system for successively uncovering at least two separate groups of contiguous spaced-apart ports along a wellbore as claimed in claim 14, wherein:

said protruding profile on a downhole side of said first or second actuation members is provided with a chamfer thereon so as to permit, after said resiliently radially-outwardly biased protruding profile on said first actuation member has matingly engaged a respective of said interior circumferential grooves on an associated sliding sleeve member and moved said sliding sleeve member to open an associated port, said resiliently-outwardly-biased profile on said first or second actuation member to be released from said mating engagement therein upon further fluid pressure being applied uphole to said plug member, to thereby allow said first or second actuation member to continue downhole to actuate additional downhole sliding sleeve members and open additional downhole ports.

18. The system for successively uncovering at least two separate groups of contiguous spaced-apart ports along a wellbore as claimed in claim 14, wherein:

each of said sliding sleeve members, at a lowermost end thereof, possess radially-outwardly biased and extending tab members, upwardly protruding ends of which engage an aperture in said tubing liner when a respective of said sliding sleeve members is moved to uncover an associated port, which ends of said tab members when engaged in said aperture prevent respective of said sliding sleeve members from moving uphole to thereby close an associated port.

19. The system for successively uncovering at least two separate groups of contiguous spaced-apart ports along a wellbore as claimed in claim 14, wherein:

said first and second actuation members are provided, at a downhole end thereof, with an annular ring of a diameter substantially equal to the diameter of the sliding sleeve members, to assist said actuation member in moving downhole in the tubular liner.

20. The system for successively uncovering at least two separate groups of contiguous spaced-apart ports along a wellbore as claimed in claim 14, wherein:

one or both of said first or second actuation members is dissolvable upon being exposed for a period of time to said fluid.

21. A method for successively uncovering a plurality of groups of spaced-apart ports along a hollow tubular liner, a first group of sliding sleeves respectively covering a first group of spaced-apart ports and being further downhole from a second group of sliding sleeves respectively covering a second group of spaced-apart ports, comprising the steps of:

(i) injecting a first actuation member having a resiliently radially-outwardly biased profile thereon of a first width down said tubular liner having a plurality of sliding sleeve members respectively covering a corresponding plurality of said first group of spaced-apart ports along said tubular liner;

(ii) flowing said first actuation member downhole by applying fluid pressure to an uphole end thereof so as to cause first actuation member to flow downhole and said profile on said first actuation member to engage an interior circumferential groove on a first of said first group of sliding sleeve members, and upon continued application of said fluid pressure uphole of said first actuation member, causing said first sliding sleeve member to move downhole and thereby uncover an associated port of said first group of ports in said tubular liner;

(iii) using said fluid pressure thereafter to cause said radially outwardly biased profile on said first actuation member to disengage said interior circumferential groove on said first of said sliding sleeve members and thereafter flow further downhole and engage an interior circumferential groove oa a second of said sliding sleeve members and cause a second of said sliding sleeve members, upon application of fluid pressure uphole of said first actuation member, to likewise move further downhole and thereby uncover an associated additional of said ports in said tubular liner;

(iv) repeating step (iii) until said first actuation member causes a lowermost of said sliding sleeve members in said first group of sliding sleeve members to move downhole and thereby uncover an associated lowermost port of said group of ports in said tubular liner;

(v) locking said first actuation member in the lowermost sliding sleeve member covering a lowermost port in said first group of ports by applying a fluid pressure uphole of said first actuation member and causing a plug member in said first actuation member to move downhole in said first actuation member to a position preventing said profile thereon from moving radially inwardly so as to disengage said circumferential groove on said respective sliding sleeve;

(vi) using said fluid pressure to inject said fluid into a hydrocarbon formation via said first group of ports in said tubular liner;

(vii) allowing fluid in said tubular liner to dissolve at least a plug in said first actuation member so as to allow flow of fluid in said tubular liner through said first actuation member;

(viii) injecting a further actuation member down said tubular liner, said further actuation member having a different profile than the profiles on said first actuation member;

(ix) causing said profile on said second actuation member to engage an interior circumferential groove on a sliding sleeve member within a second group of sliding sleeves uphole of said first group of ports and associated sliding sleeves, and upon application of fluid pressure uphole of said further actuation member, causing said uphole sliding sleeve member in said second group of sliding sleeves to move downhole and thereby uncover an additional associated of said ports in said tubular liner, and thereafter by applying fluid pressure causing said profile on said further actuation member to become disengaged therefrom and causing said further actuation member to then move further downhole to engage further successive sliding sleeves covering respective ports in said second group of spaced-apart ports;

(x) repeating step (ix) until all of said plurality of spaced-apart ports along said tubular liner in said second group of spaced-apart ports have been opened;

(xi) locking said further actuation member in the lowermost sliding sleeve member of said second group of sliding sleeves by applying a fluid pressure uphole of said first actuation member and causing a plug member in said first actuation member to move downhole in said first actuation member to a position preventing said profile thereon from moving radially inwardly so as to thereby prevent disengagement with said circumferential groove on said respective sliding sleeve;

(xii) injecting fracking fluid into said hydrocarbon formation via said second group of ports; and (xiii) allowing fluid in said tubular liner to dissolve at least a plug in said further actuation member so as to allow flow of fluid in said tubular liner through said further actuation member.

* * * * *